US009083083B2

(12) United States Patent
Hills et al.

(10) Patent No.: US 9,083,083 B2
(45) Date of Patent: Jul. 14, 2015

(54) RADOME ATTACHMENT BAND CLAMP

(75) Inventors: Chris Hills, Glenrothes (GB); Alastair D Wright, Edingburgh (GB); Ian Renilson, Fife (GB)

(73) Assignee: CommScope Technologies LLC, Hickory, NC (US)

( * ) Notice: Subject to any disclaimer, the term of this patent is extended or adjusted under 35 U.S.C. 154(b) by 417 days.

(21) Appl. No.: 13/600,544

(22) Filed: Aug. 31, 2012

(65) Prior Publication Data

US 2013/0002515 A1 Jan. 3, 2013

Related U.S. Application Data

(63) Continuation-in-part of application No. 12/636,068, filed on Dec. 11, 2009, now Pat. No. 8,259,028.

(51) Int. Cl.

| | |
|---|---|
| ***H01Q 1/42*** | (2006.01) |
| ***H01Q 15/14*** | (2006.01) |
| ***H01Q 15/16*** | (2006.01) |

(52) U.S. Cl.

CPC ..... *H01Q 15/14* (2013.01); *H01Q 1/42* (2013.01); *H01Q 15/16* (2013.01)

(58) Field of Classification Search

USPC ..... 343/781 P, 781 R, 872, 912, 840

See application file for complete search history.

(56) References Cited

U.S. PATENT DOCUMENTS

| | | | |
|---|---|---|---|
| 2,413,187 | A | 12/1946 | McCurdy et al. |
| 3,140,491 | A | 7/1964 | Ashbaugh et al. |
| 3,599,219 | A | 8/1971 | Holtum et al. |
| 4,410,892 | A | 10/1983 | Knop et al. |
| 4,581,615 | A | 4/1986 | Levy |
| 4,710,777 | A | 12/1987 | Halverson |
| 4,876,554 | A | 10/1989 | Tubbs |
| 4,920,350 | A | 4/1990 | McGuire et al. |
| 5,298,911 | A | 3/1994 | Li |
| 5,341,150 | A | 8/1994 | Joy |
| 5,729,241 | A | 3/1998 | Ergen et al. |
| 6,137,449 | A | 10/2000 | Kildal |
| 6,339,393 | B1 | 1/2002 | Burnside et al. |

(Continued)

FOREIGN PATENT DOCUMENTS

| | | |
|---|---|---|
| EP | 0154240 | 9/1985 |

OTHER PUBLICATIONS

O. Bucci, G. Franceschetti, Rim Loaded Reflector Antennas, IEEE Transactions on Antennas and Propagation, vol. AP-28, No. 3, p. 297-305 May 1980.

(Continued)

*Primary Examiner* — Dieu H Duong

(74) *Attorney, Agent, or Firm* — Babcock IP, PLLC

(57) ABSTRACT

A band clamp for coupling a radome to a distal end of a reflector dish for improving the front to back ratio of a reflector antenna, is provided with an inward projecting proximal lip and an inward projecting distal lip. The distal lip is dimensioned with an inner diameter equal to or less than a reflector aperture of the reflector dish. The proximal lip may be provided with an inward bias dimensioned to engage the reflector dish in an interference fit and/or turnback region dimensioned to engage an outer surface of a signal area of the reflector dish in an interference fit. A variety of different configurations of protruding portions extending from the band clamp may be applied to further improve electrical performance.

14 Claims, 26 Drawing Sheets

(56) References Cited

U.S. PATENT DOCUMENTS

| | | | | |
|---|---|---|---|---|
| 6,522,305 | B2 | 2/2003 | Sharman | |
| 7,138,958 | B2 | 11/2006 | Syed et al. | |
| 8,259,028 | B2 * | 9/2012 | Hills et al. | 343/872 |
| 2001/0045917 | A1 | 11/2001 | Fedder et al. | |
| 2005/0099350 | A1 | 5/2005 | Gothard et al. | |
| 2005/0190116 | A1 | 9/2005 | Syed et al. | |
| 2007/0268198 | A1 | 11/2007 | Marshall et al. | |
| 2011/0140983 | A1 | 6/2011 | Hills et al. | |
| 2013/0082896 | A1 * | 4/2013 | Renilson et al. | 343/872 |

OTHER PUBLICATIONS

O. Bucci, G. Di Massa, C. Savarese, Control of Reflector Antennas Performance by Rim Loading, IEEE Transactions on Antennas and Propagation, vol. AP-29, No. 5, p. 773-779 Sep. 1981.

O. Bucci, C. Gennarelli, L. Palumbo, Flanged Parabolic Antennas, IEEE Transactions on Antennas and Propagation, vol. AP-30, No. 6, p. 1081-1085 Nov. 1982.

O. Bucci, C. Gennarelli, L. Palumbo, Parabolic Antennas with a Loaded Flange, IEEE Transactions on Antennas and Propagation, vol. AP-33, No. 7, p. 755-762, Jul. 1985.

International Search Report and Written Opinion, International Application serial No. PCT/IB2010/054173, 8 pages, Daejeon, Republic of Korea, Jun. 27, 2011.

Kang Sung Chul, International Search Report for Corresponding PCT application PCT/US13/40130, Sep. 23, 2013, Daejeon Metropolitan City, Korea.

* cited by examiner

RADOME ATTACHMENT BAND CLAMP

CROSS REFERENCE TO RELATED APPLICATIONS

This application is a continuation-in-part of commonly owned co-pending U.S. patent application Ser. No. 12/636,068, titled "Reflector Antenna Radome Attachment Band Clamp" filed 11 Dec. 2009 by Chris Hills, Matthew Lewry, Tracy Donaldson and Bruce Hughes, hereby incorporated by reference in its entirety.

BACKGROUND

1. Field of the Invention

This invention relates to microwave reflector antennas. More particularly, the invention relates to a reflector antenna with a radome and reflector dish interconnection band clamp which enhances signal pattern and mechanical interconnection characteristics.

2. Description of Related Art

The open end of a reflector antenna is typically enclosed by a radome coupled to the distal end of the reflector dish. The radome provides environmental protection and improves wind load characteristics of the antenna.

Edges and/or channel paths of the reflector dish, radome and/or interconnection hardware may diffract or enable spillover of signal energy present in these areas, introducing undesirable backlobes into the reflector antenna signal pattern quantified as the front to back ratio (F/B) of the antenna. The F/B is regulated by international standards, and is specified by for example, the FCC in 47 CFR Ch. 1 Part 101.115 in the United States, by ETSI in EN302217-4-1 and EN302217-4-12 in Europe, and by ACMA RALI FX 3 Appendix 11 in Australia.

Prior antenna signal pattern backlobe suppression techniques include adding a backlobe suppression ring to the radome, for example via metalizing of the radome periphery as disclosed in commonly owned U.S. Pat. No. 7,138,958, titled "Reflector Antenna Radome with Backlobe Suppressor Ring and Method of Manufacturing" issued Nov. 21, 2006 to Syed et al, hereby incorporated by reference in its entirety. However, the required metalizing operations may increase manufacturing complexity and/or cost, including elaborate coupling arrangements configured to securely retain the shroud upon the reflector dish without presenting undesired reflection edges, signal leakage paths and/or extending the overall size of the radome. Further, the thin metalized ring layer applied to the periphery of the radome may be fragile, requiring increased care to avoid damage during delivery and/or installation.

Reflectors employing castellated edge geometries to generate constructive interference of the edge diffraction components have also been shown to improve the F/B, for example as disclosed in commonly owned Canada Patent No. CA887303 "Backlobe Reduction in Reflector-Type Antennas" by Holtum et al. Such arrangements increase the overall diameter of the antenna, which may complicate radome attachment, packaging and installation.

The addition of a shroud to a reflector antenna improves the signal pattern generally as a function of the shroud length, but also similarly introduces significant costs as the increasing length of the shroud also increases wind loading of the reflector antenna, requiring a corresponding increase in the antenna and antenna support structure strength. Further, an interconnection between the shroud and a radome may introduce significant F/B degradation.

A conventional band clamp 1 applied to retain a radome 3 upon the reflector dish 7 or shroud may introduce diffraction edges and/or signal leakage paths, for example as shown in FIG. 1. Metal taping, RF gaskets or the like may be applied to reduce F/B degradation resulting from band clamp use. However, these materials and procedures increase manufacturing costs and/or installation complexity and may be of limited long-term reliability.

Competition in the reflector antenna market has focused attention on improving electrical performance and minimization of overall manufacturing, inventory, distribution, installation and maintenance costs. Therefore, it is an object of the invention to provide a reflector antenna that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
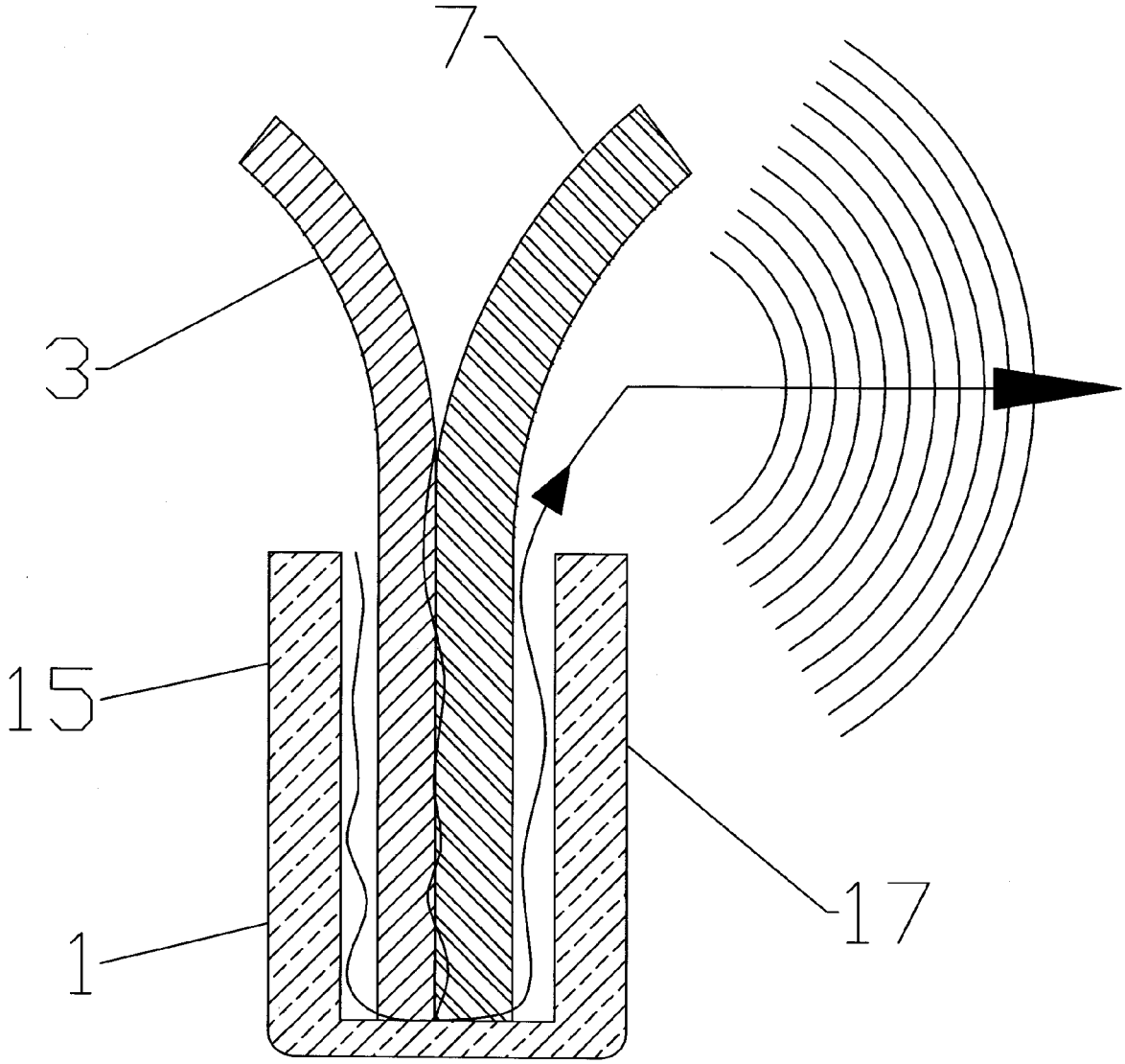
Fig. 1 Prior Art
FIG. 1 is a schematic enlarged cut-away side view of a conventional prior art band clamp radome and reflector dish interconnection, demonstrating an RF signal leakage path.
Figure 2:
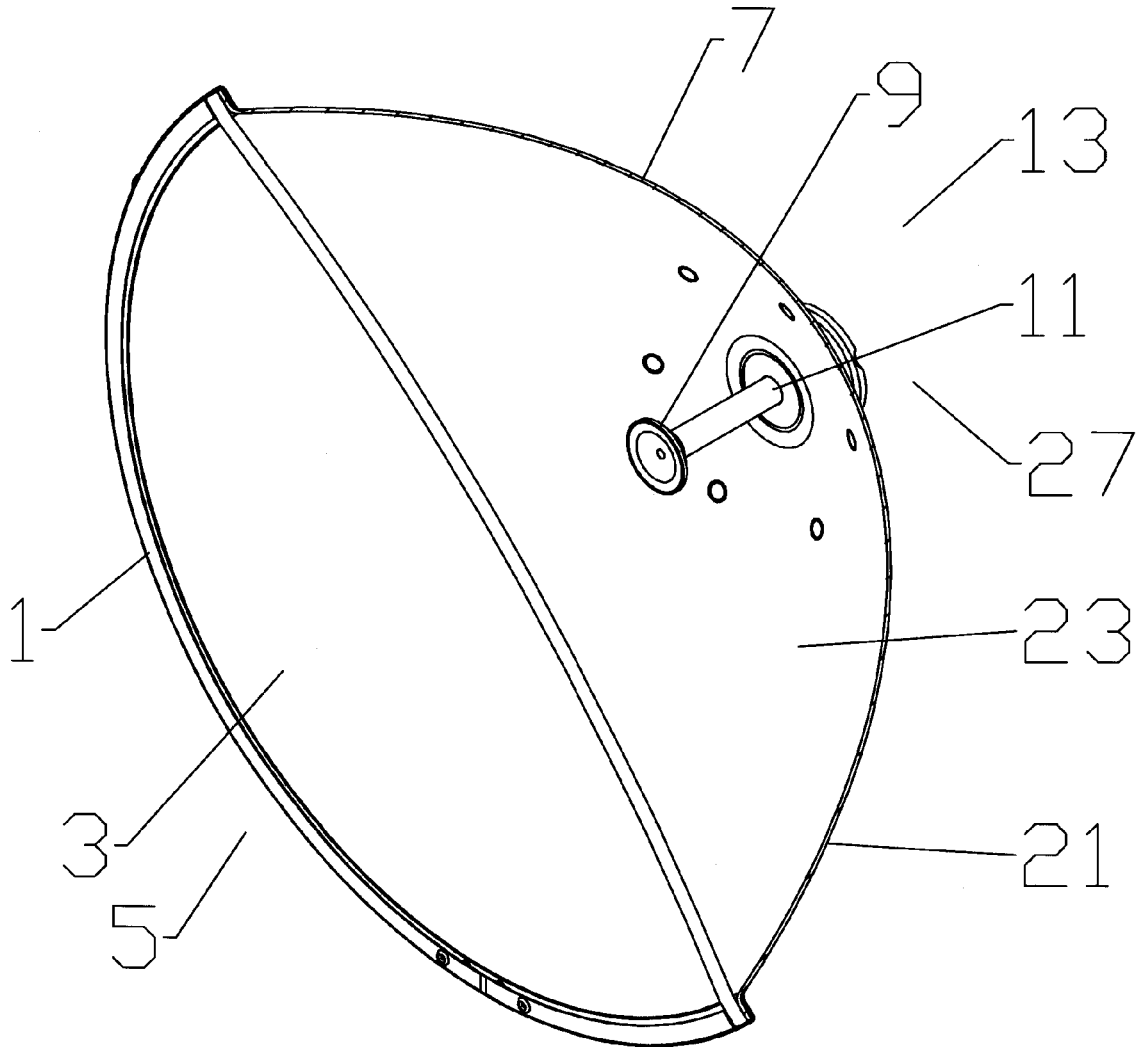
FIG. 2 is a schematic isometric cut-away view of a reflector antenna with radome to reflector dish band clamp interconnection.
Figure 3:
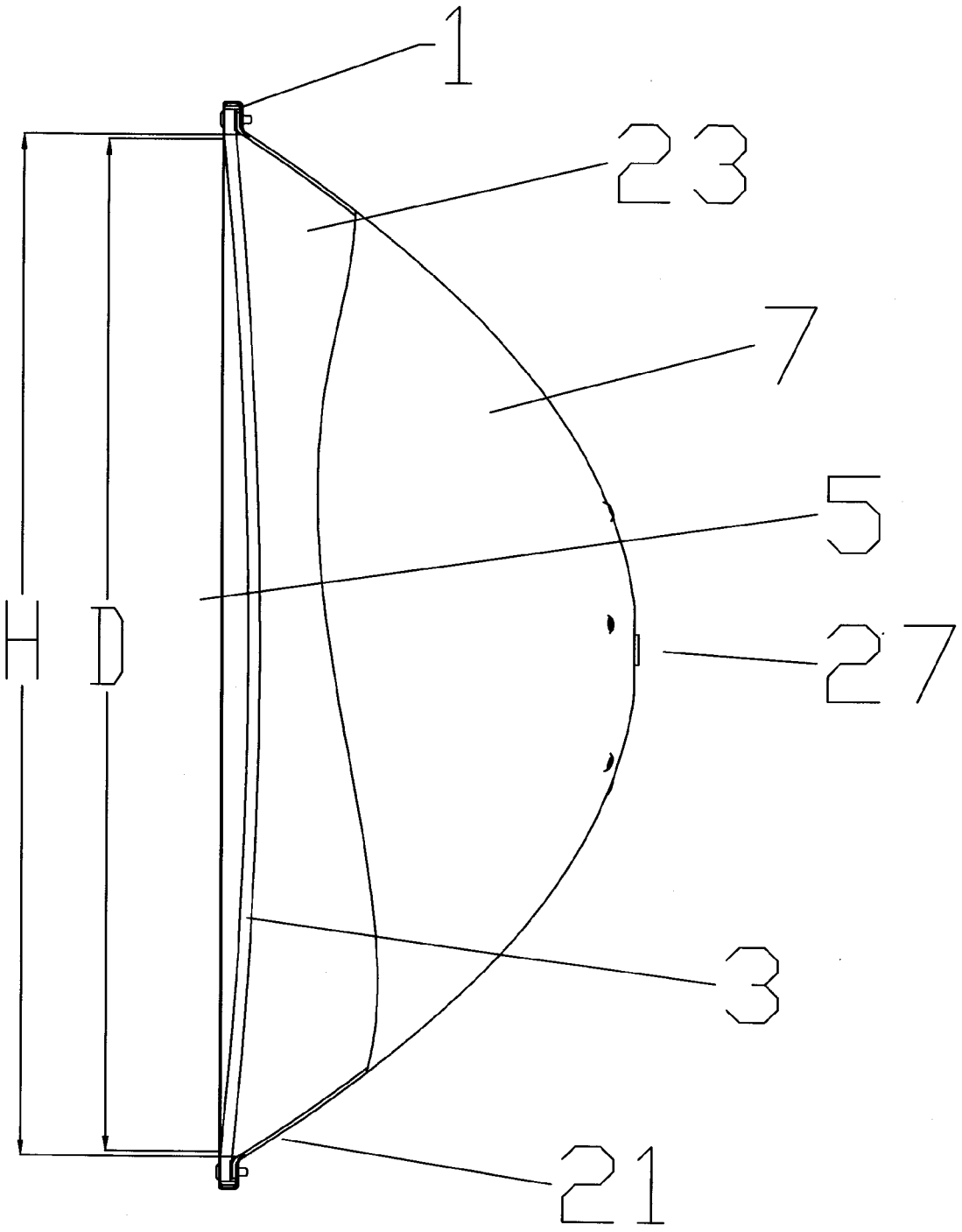
FIG. 3 is a schematic partial cut-away side view of a radome to reflector dish band clamp interconnection.
Figure 4:
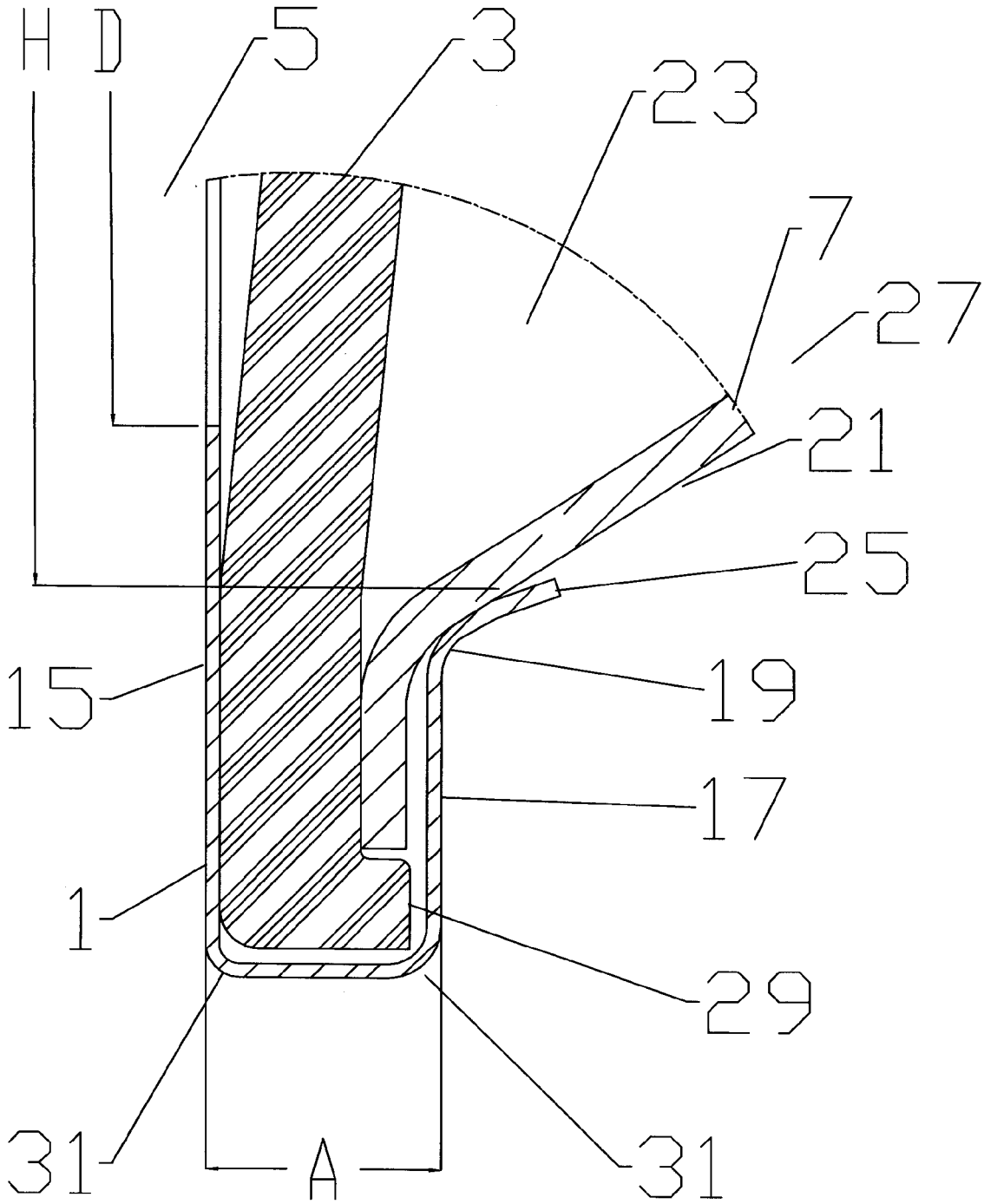
FIG. 4 is an enlarged cut-away side view of a first exemplary radome to reflector dish band clamp interconnection.

As shown in FIGS. 2 and 3, a band clamp 1 is generally operative to retain a radome 3 upon the open distal end 5 of a reflector dish 7, creating an environmental seal that protects the reflector dish 7, subreflector 9 and/or feed 11 of a reflector antenna 13 from environmental fouling. In a first exemplary embodiment, best shown in FIG. 4, the band clamp 1 is provided with inward facing distal and proximal lips 15, 17. A turnback region 19 of the proximal lip 17 is dimensioned to engage the outer surface 21 of the signal area 23 of the reflector dish 7. The turnback region 19 may be applied, for example, as an outward bend prior to the inward end 25 of the proximal lip 17.

As the band clamp 1 is tightened during interconnection of the radome 3 and the reflector dish 7, the diameter of the band clamp 1 is progressively reduced, driving the turnback region 19 against the convex outer surface 21 of the signal area 23 of the reflector dish 7, into a uniform circumferential interference fit. As the band clamp 1 is further tightened, the turnback region 19 slides progressively inward along the outer surface 21 of the signal area 23 of the reflector dish 7 toward the reflector dish proximal end 27. Thereby, the distal lip 15 of the band clamp 1 also moves towards the reflector dish proximal end 27, securely clamping the radome 3 against the distal end 5 of the reflector dish 7. Because the interference fit between the turnback region 19 and the outer surface 21 of the reflector dish 7 is circumferentially uniform, any RF leakage between these surfaces is reduced.

Although it is possible to apply extended flanges to the reflector dish 7 and/or radome 3, these may unacceptably increase the overall size of the reflector antenna 1, which may negatively impact wind loading, material requirements, inventory and transport packaging requirements. Therefore, flanges of a reduced size, dimensioned to provide secure mechanical interconnection, may be applied. The radome 3 may be provided with a greater diameter than the reflector dish 7, an annular lip 29 of the radome periphery mating with an outer diameter of the distal end 5 of the reflector dish 7, keying the radome 3 coaxial with the reflector dish 7 and providing surface area for spacing the band clamp 1 from the signal area 23 of the reflector dish 7.

Figure 5:
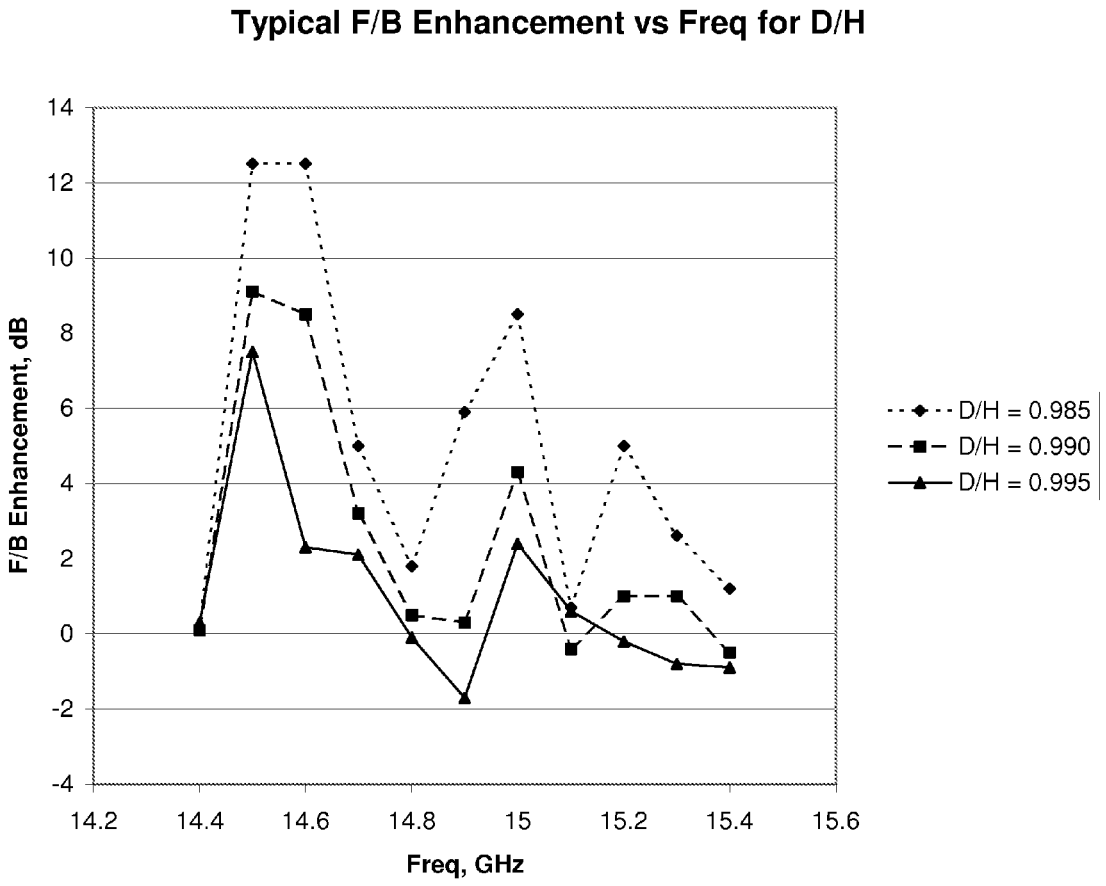
FIG. 5 is a graph illustrating a range of exemplary band clamp distal lip inner diameter to reflector dish aperture ratios and their effect upon corresponding reflector antenna F/B over a range of operating frequencies.

The flanges may be dimensioned and the band clamp 1 similarly dimensioned such that the distal lip 15 of the band clamp 1 is even with or extends slightly inward of a reflector aperture H, defined as the largest diameter of the reflector dish surface upon which signal energy is distributed by the subreflector 9, to form a band clamp inner diameter D. To minimize diffraction and/or scatter signal components at the band clamp distal lip 15, the band clamp inner diameter D may be dimensioned with respect to reflector aperture H, resulting in significant F/B enhancement as illustrated in FIG. 5. For reduced F/B in a reflector antenna 13 of minimal overall diameter, a D/H ratio of 0.97-1.0 may be applied.

Figure 6:
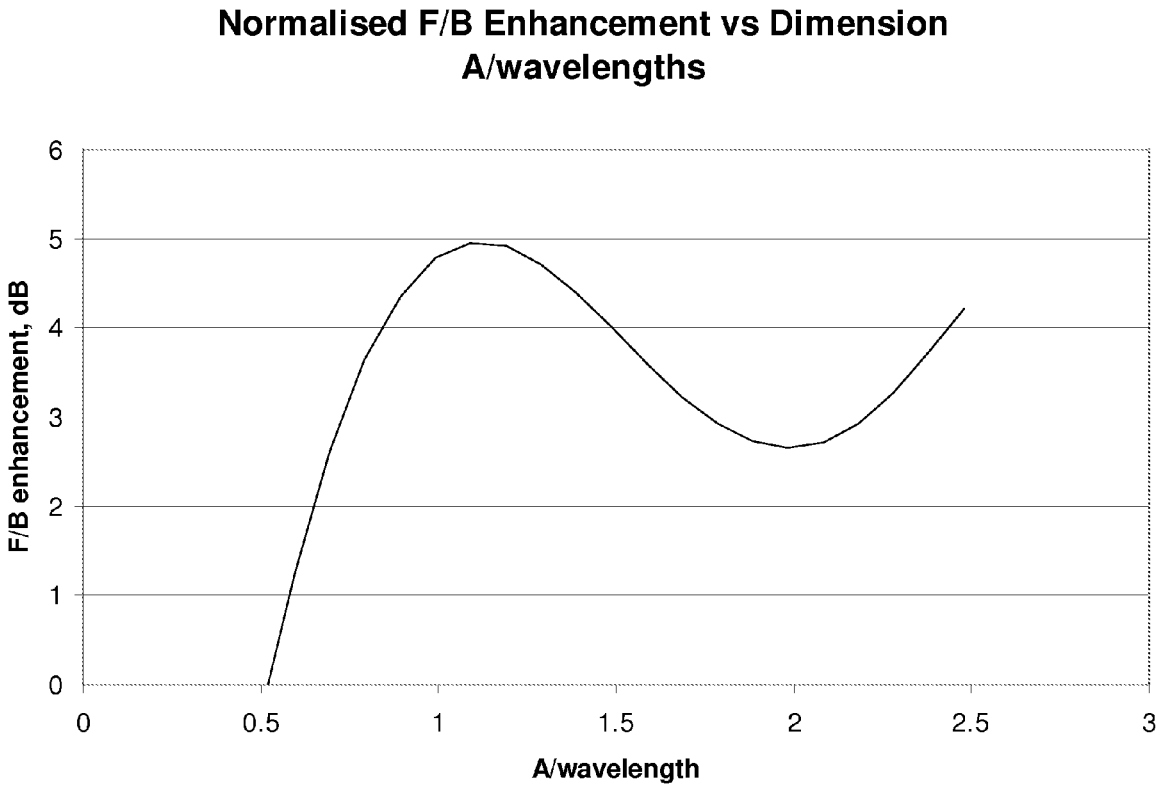
FIG. 6 is a graph illustrating a range of band clamp widths and their effect upon corresponding reflector antenna F/B.

Referring again to FIG. 4, another dimension of the band clamp 1 impacting the F/B is the band clamp 1 width "A" which determines the distance between band clamp outer corner(s) 31 acting as diffraction/scatter surfaces. As shown in FIG. 6, normalized F/B is improved when the width "A" is between 0.8 and 1.5 wavelengths of the operating frequency, which can be operative to generate mutual interference of surface currents traveling along the band clamp outer periphery and/or scatter interference.

Figure 7:
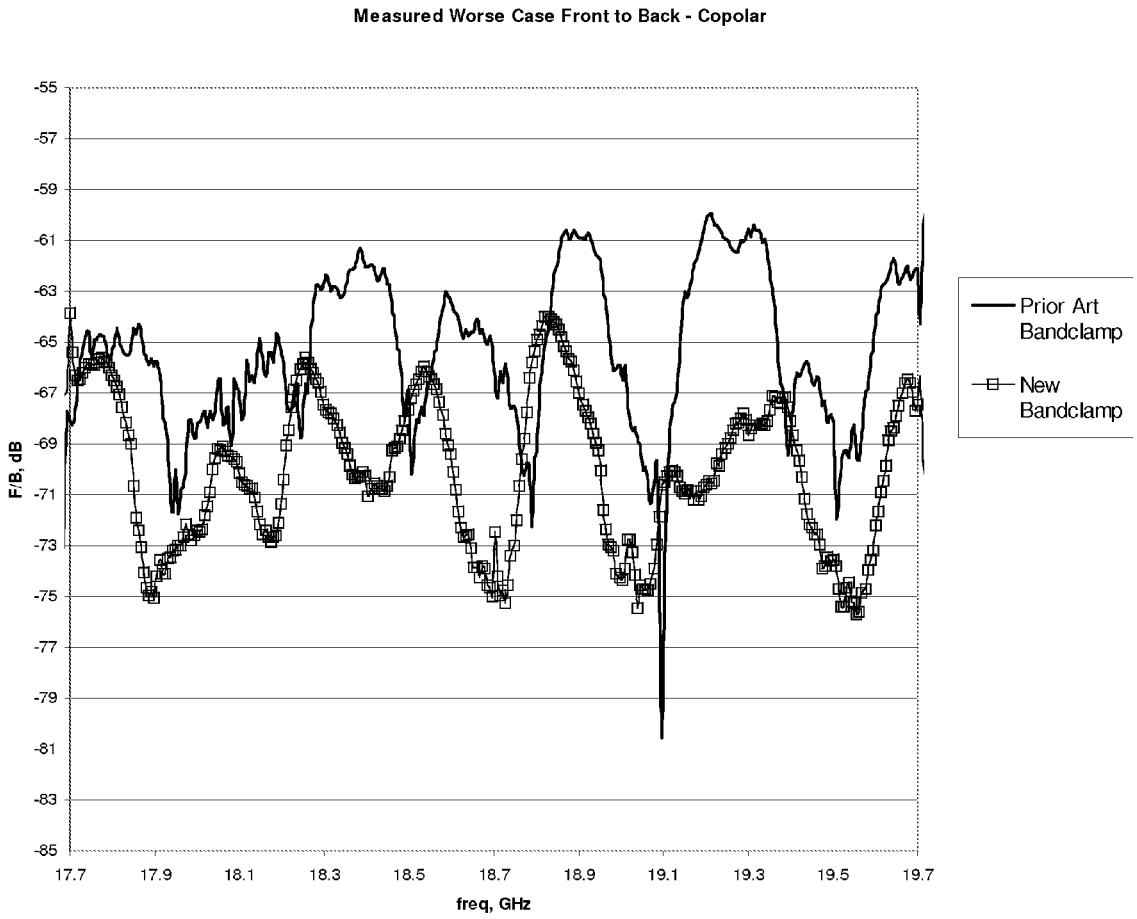
FIG. 7 is a graph comparing measured co-polar F/B performance related to RF signal leakage between conventional band clamp and presently disclosed "new" band clamp configurations.
Figure 8:
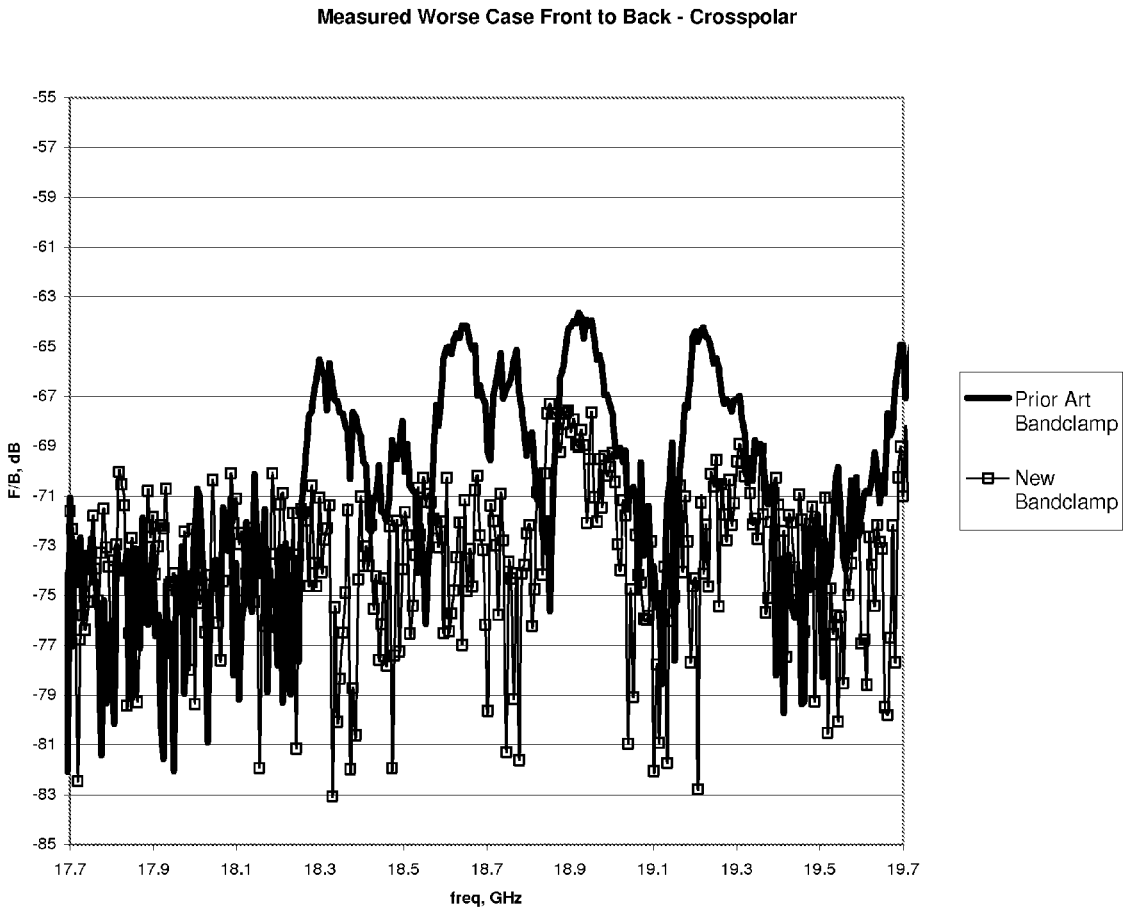
FIG. 8 is a graph comparing measured cross-polar F/B performance related to RF signal leakage between conventional band clamp and presently disclosed "new" band clamp configurations.
Figure 9:
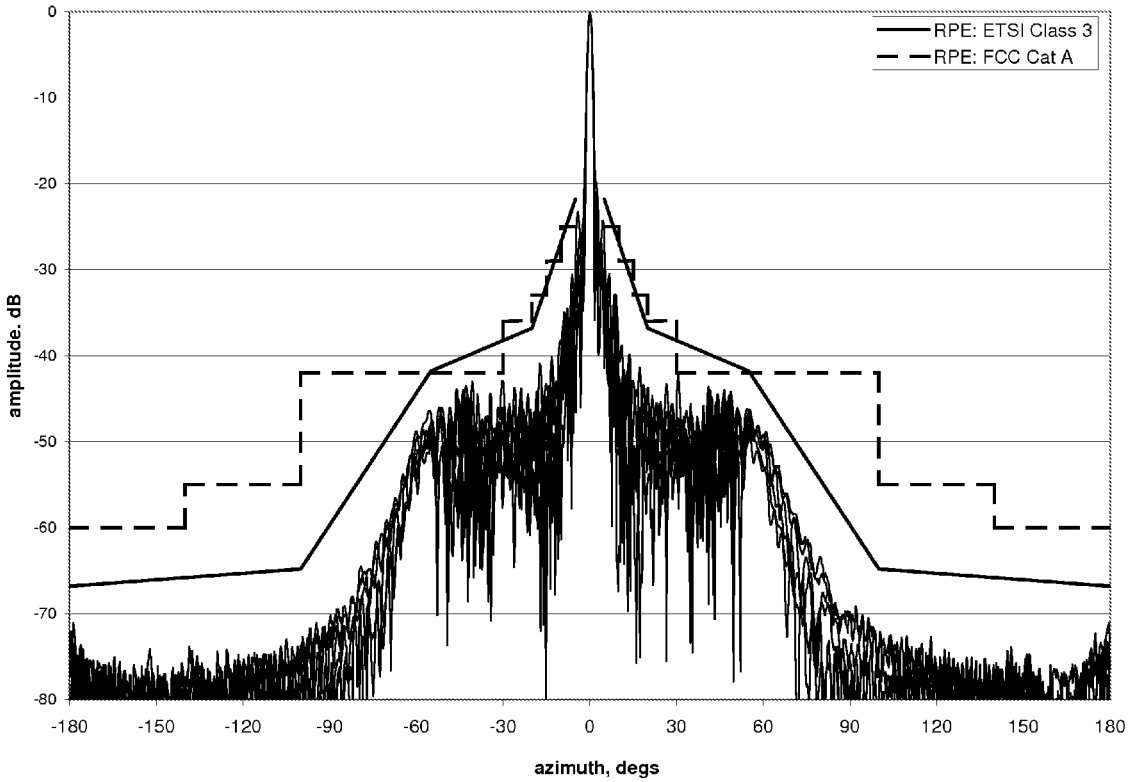
FIG. 9 is a graph of measured co-polar radiation patterns of a 0.6 m reflector antenna with a band clamp with a 1.1 wavelength width.
Figure 10:
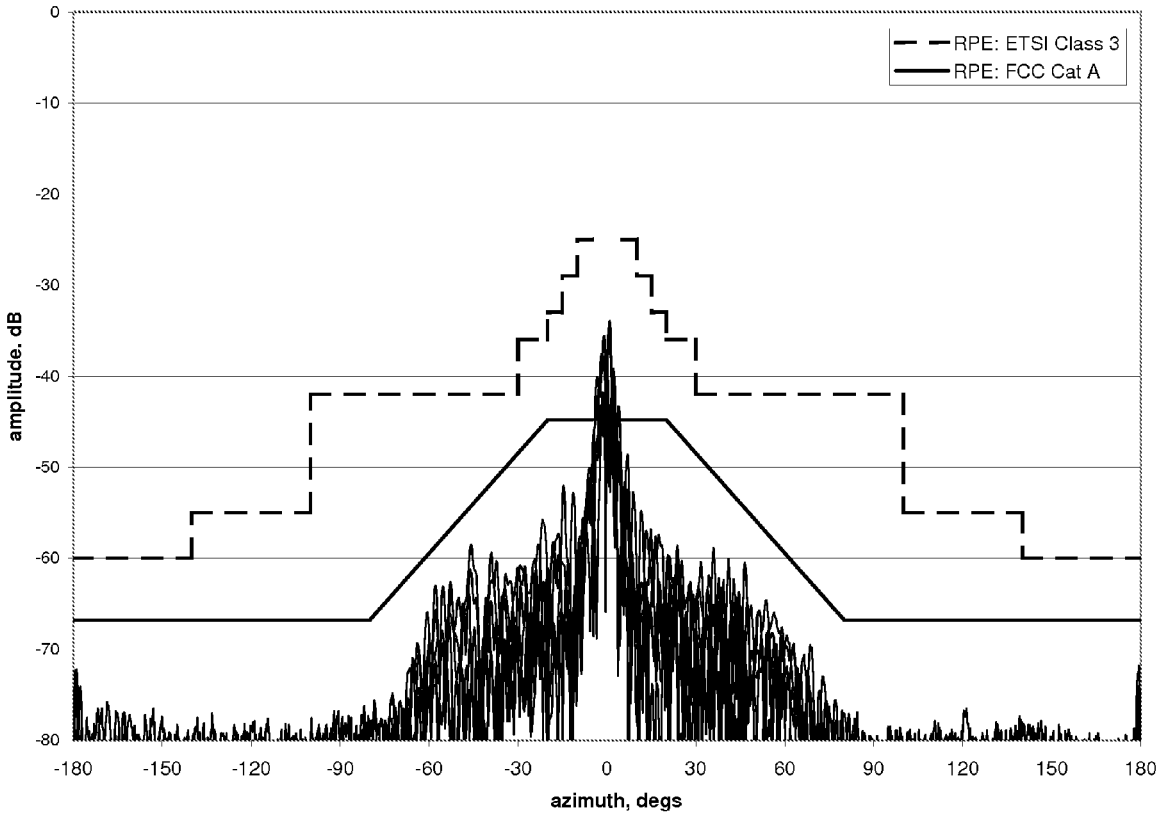
FIG. 10 is a graph of measured cross-polar radiation patterns of a 0.6 m reflector antenna with a band clamp with a 1.1 wavelength width.

The significant improvement in measured F/B performance in a 0.6 meter reflector antenna configurations for both co-polar and cross-polar responses with a conventional prior art band clamp 1 and the "new" presently disclosed band clamp configuration are illustrated in FIGS. 7 and 8. FIGS. 9 and 10 illustrate measured backlobe levels of co-polar and cross-polar radiation patterns in the 26 GHz band within the regulatory envelopes at greater than 71 dB with the band clamp configuration shown in FIG. 4, in which the width "A" is equal to 1.1 wavelengths.

Figure 11:
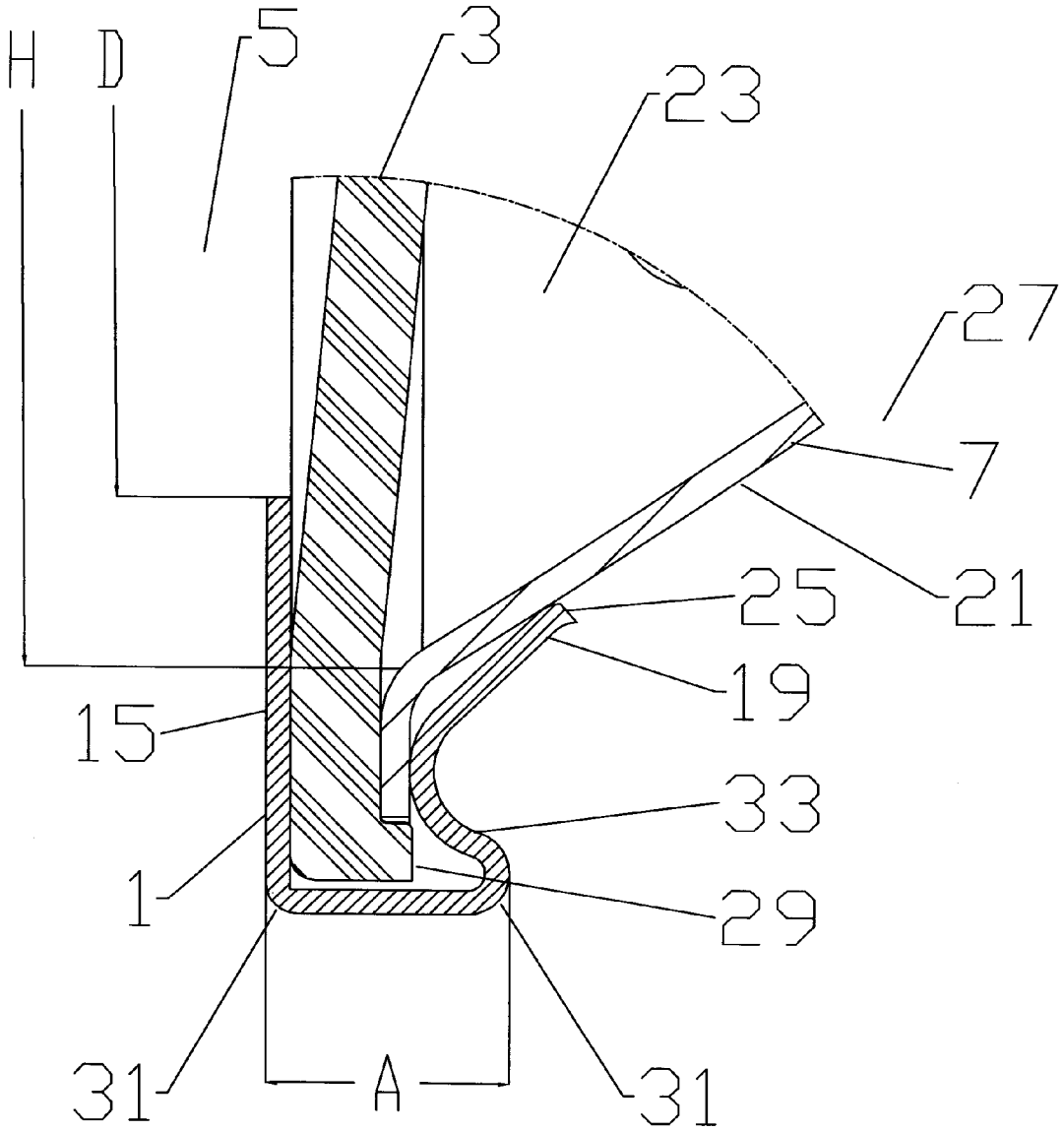
FIG. 11 is an enlarged cut-away side view of a second exemplary radome to reflector dish band clamp interconnection.

One skilled in the art will appreciate that the optimal range of widths "A" may be difficult to achieve for some operating frequencies without incorporating further structure in the radome and/or reflector dish periphery. In a second embodiment, for example as shown in FIG. 11, the width "A" may be increased via the application of a fold 33 in the band clamp from the desired extent of the width "A" back toward the reflector dish 7. The pictured embodiment is simplified for demonstration purposes with respect to extending the width "A" but may similarly be applied with a fold 33 and proximal lip 17 that extends further inward and includes a turnback region 19 contacting the outer surface 21 of the signal area 23 of the reflector dish 7.

Figure 12:
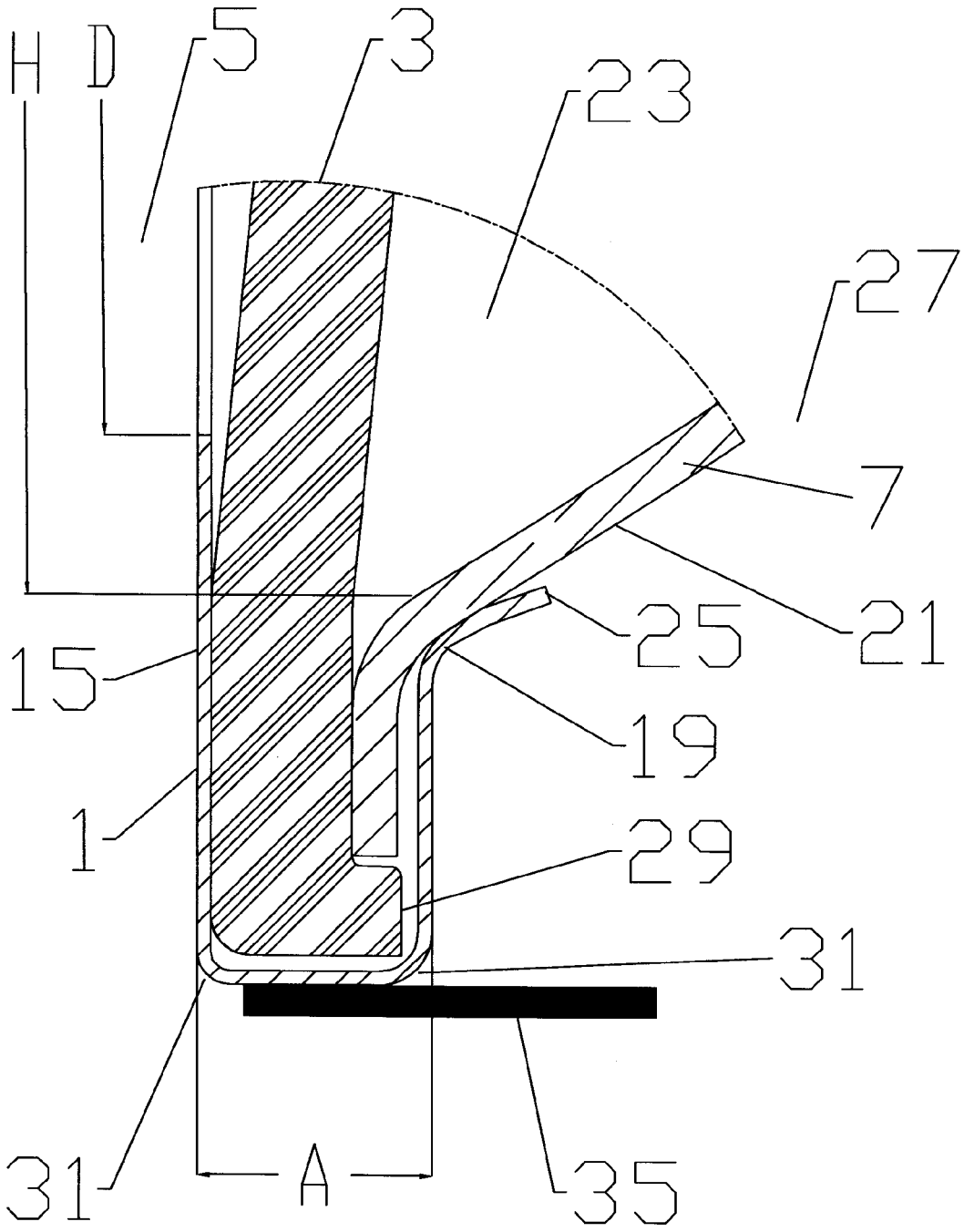
FIG. 12 is an enlarged cut-away side view of a third exemplary radome to reflector dish band clamp interconnection, including a width ring.

In a third embodiment, for example as shown in FIG. 12, an extension of the width "A" may be cost effectively achieved by attaching a further width ring 35 of metallic and/or metal coated material to the band clamp 1 outer diameter. The width ring 35 may be applied with any desired width, cost effectively securely attached by spot welding or fasteners such as screws, rivets or the like.

Figure 13:
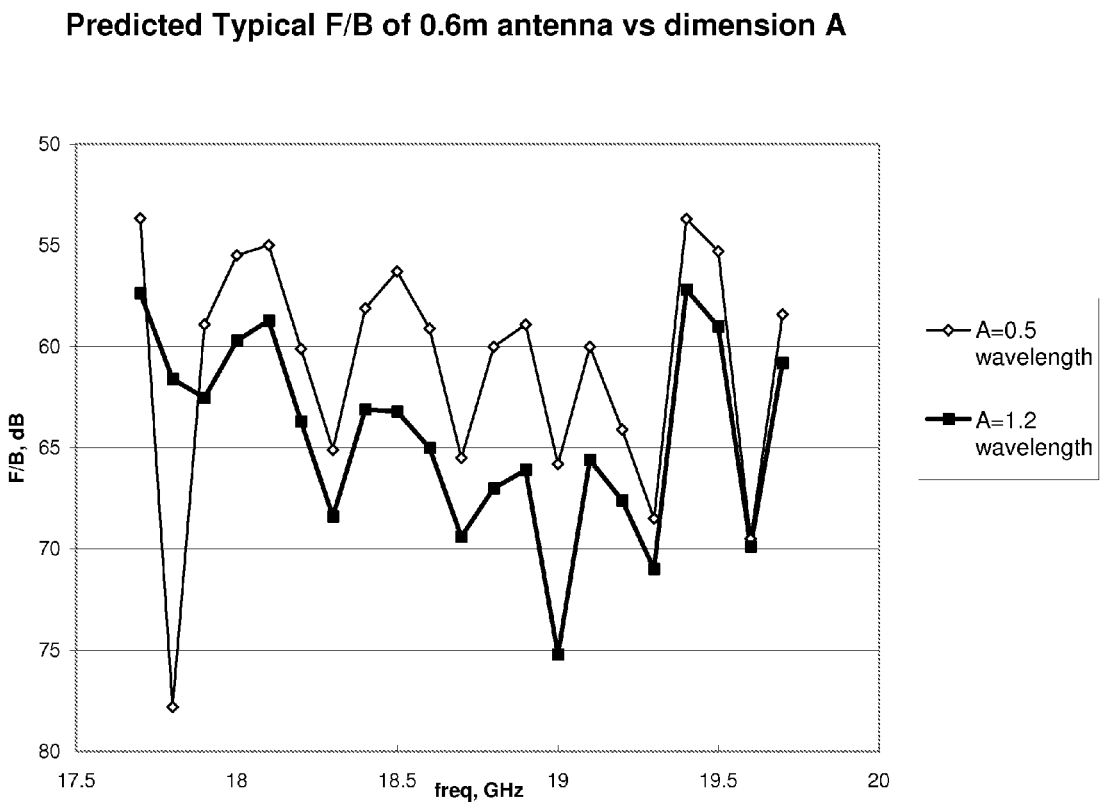
FIG. 13 is a graph comparing predicted F/B enhancement with a band clamp of width of 0.5 and 1.2 wavelengths.
Figure 14:
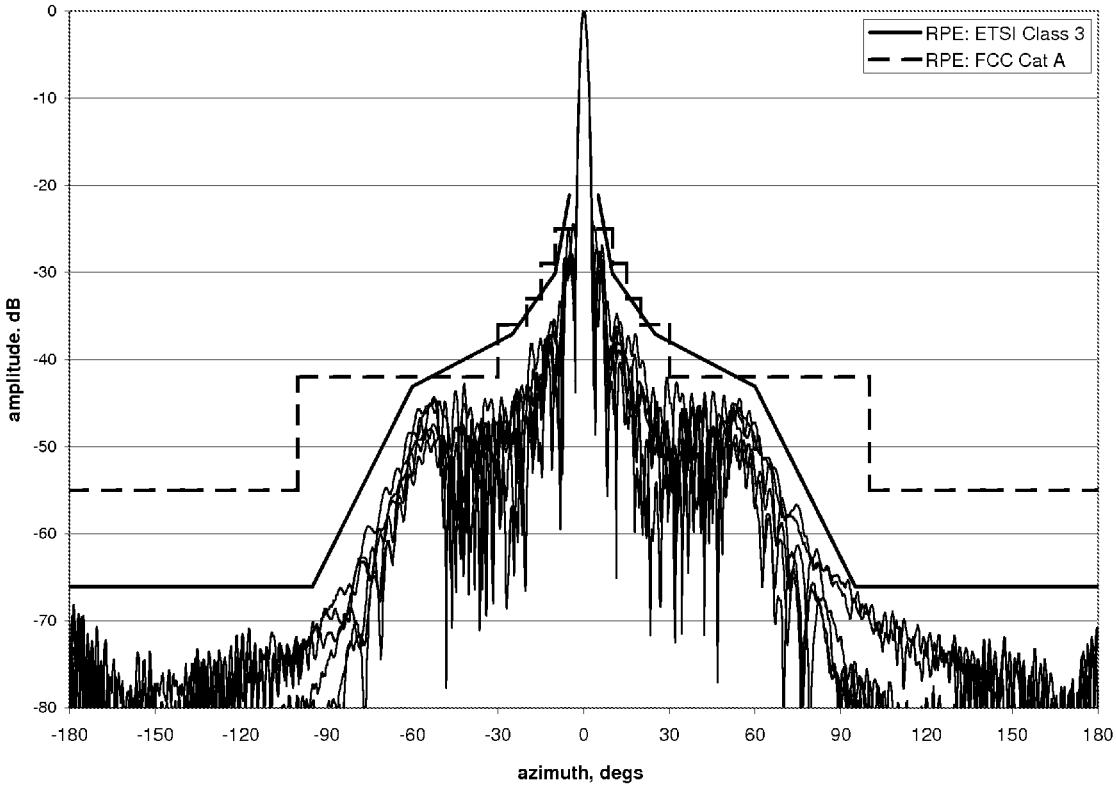
FIG. 14 is a graph of measured co-polar radiation patterns for a reflector antenna with a band clamp with a 0.5 wavelength width.
Figure 15:
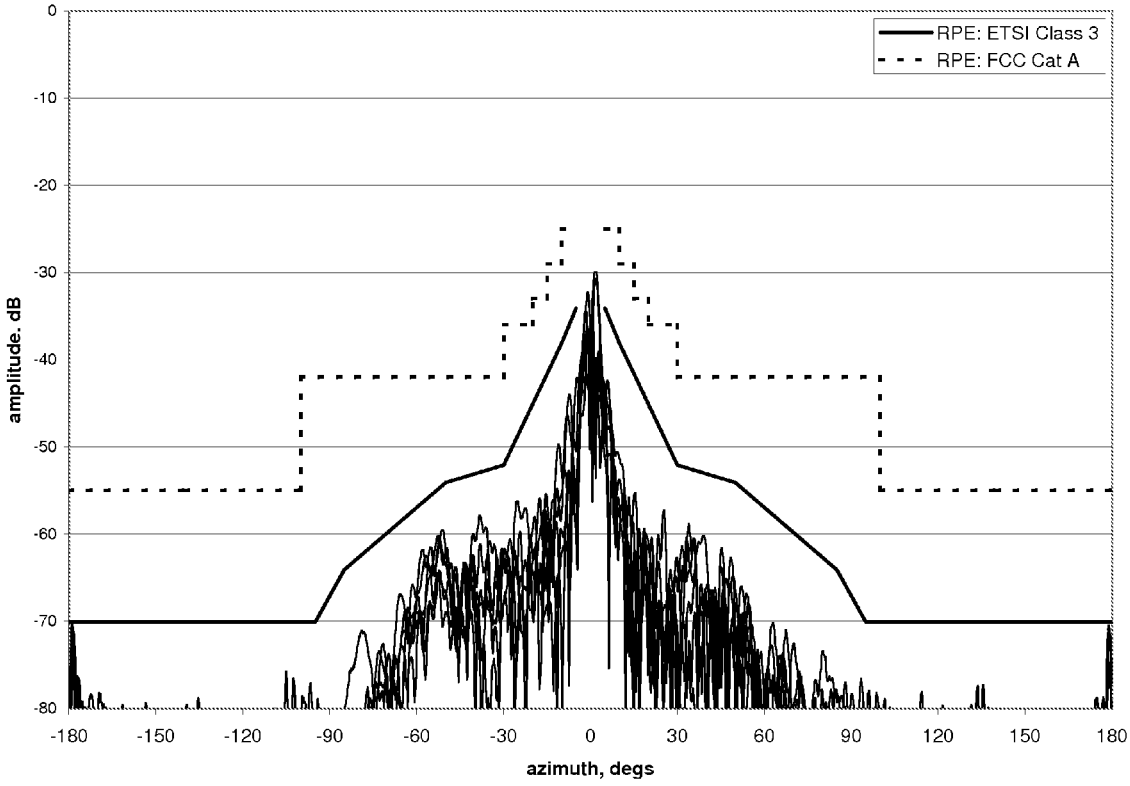
FIG. 15 is a graph of measured cross-polar radiation patterns for a reflector antenna with a band clamp with a 0.5 wavelength width.
Figure 16:
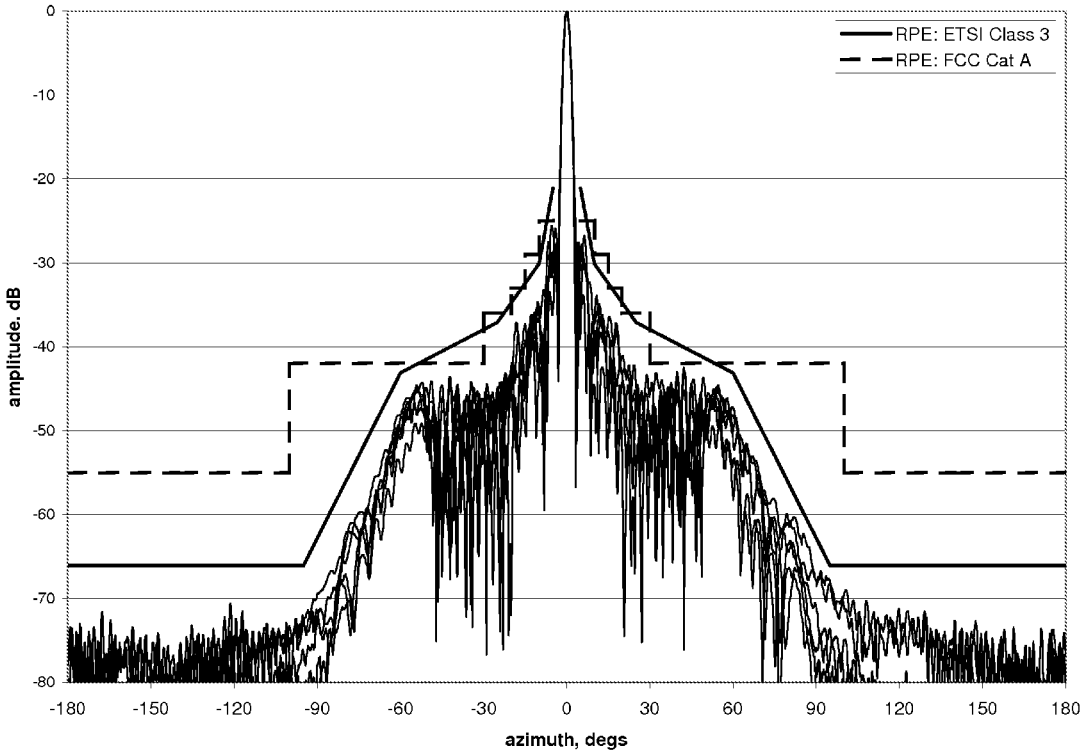
FIG. 16 is a graph of measured co-polar radiation patterns for a reflector antenna with a band clamp with a 1.2 wavelength width.
Figure 17:
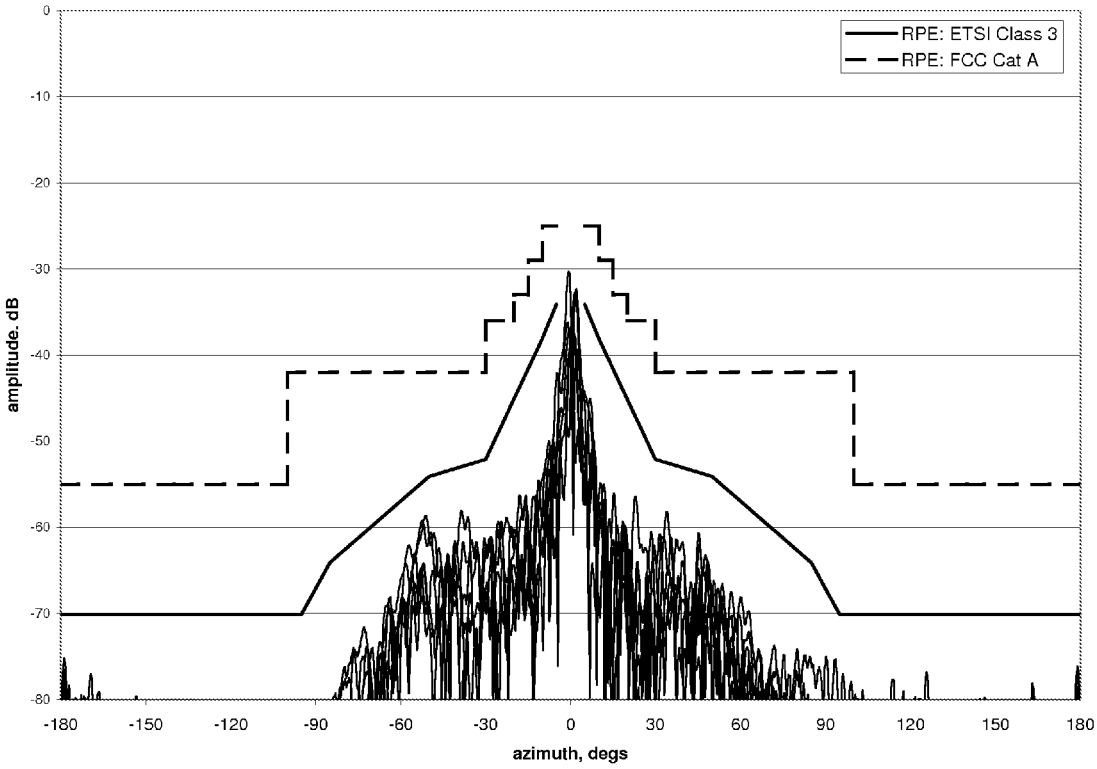
FIG. 17 is a graph of measured cross-polar radiation patterns for a reflector antenna with a band clamp with a 1.2 wavelength width.

FIG. 13 illustrates 18 GHz band RF modeling software predictions of F/B improvement between a width ring 35 width "A" of 0.5 and 1.2 wavelengths. Measured co-polar and cross-polar F/B performance of a FIG. 12 band clamp 1 with width ring 35 of width "A"=0.5 wavelengths is shown in FIGS. 14 and 15. Note the performance meets the regulatory envelope across the entire range, but with no margin. However, as shown in FIGS. 16 and 17, the measured co-polar and cross-polar F/B performance of a FIG. 12 band clamp 1 with width ring 35 of width "A"=1.2 wavelengths is significantly improved and well within the regulatory envelope throughout the entire range.

Figure 18:
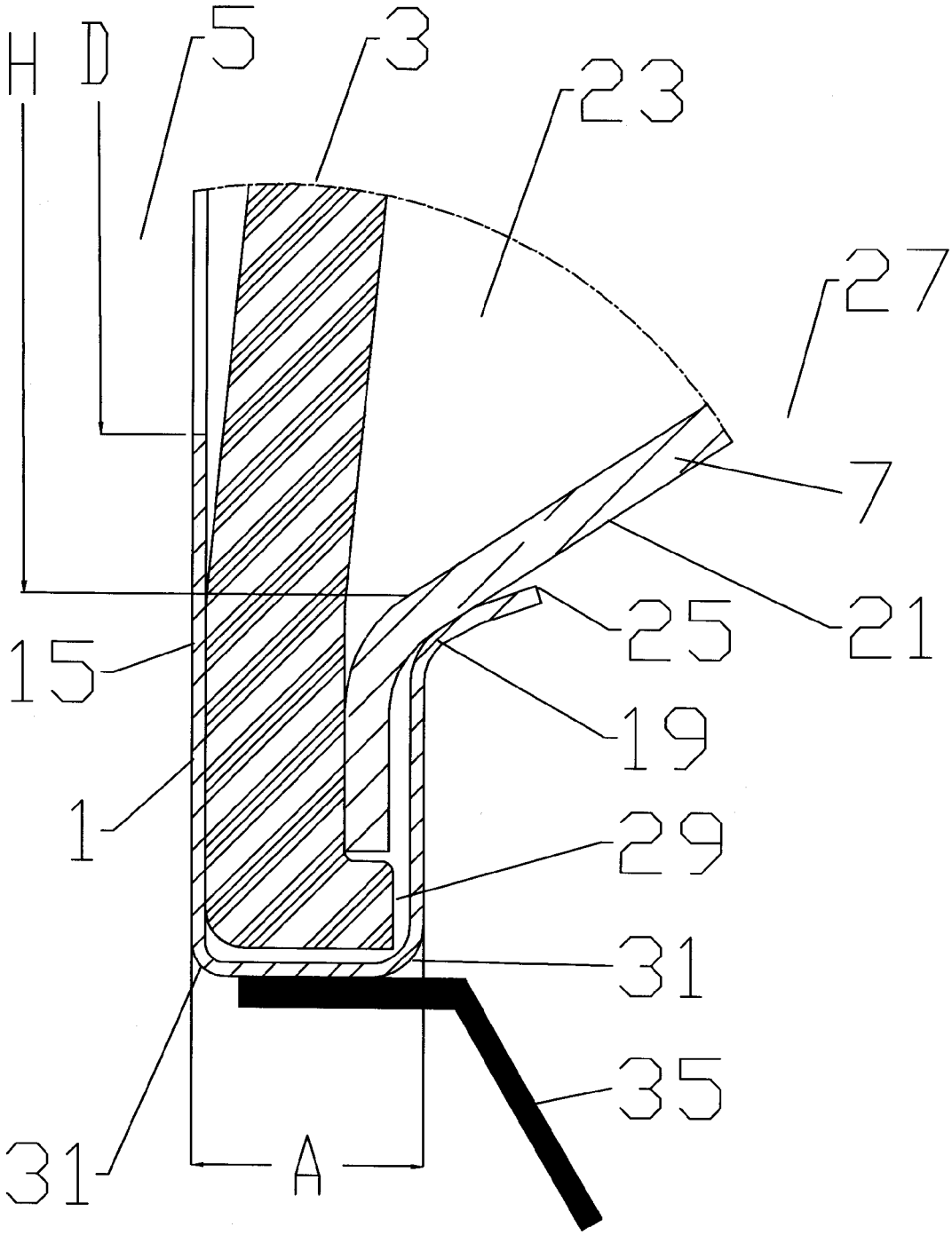
FIG. 18 is an enlarged cut-away side view of a third exemplary radome to reflector dish band clamp interconnection, including a width ring with radial outward bend.
Figure 19:
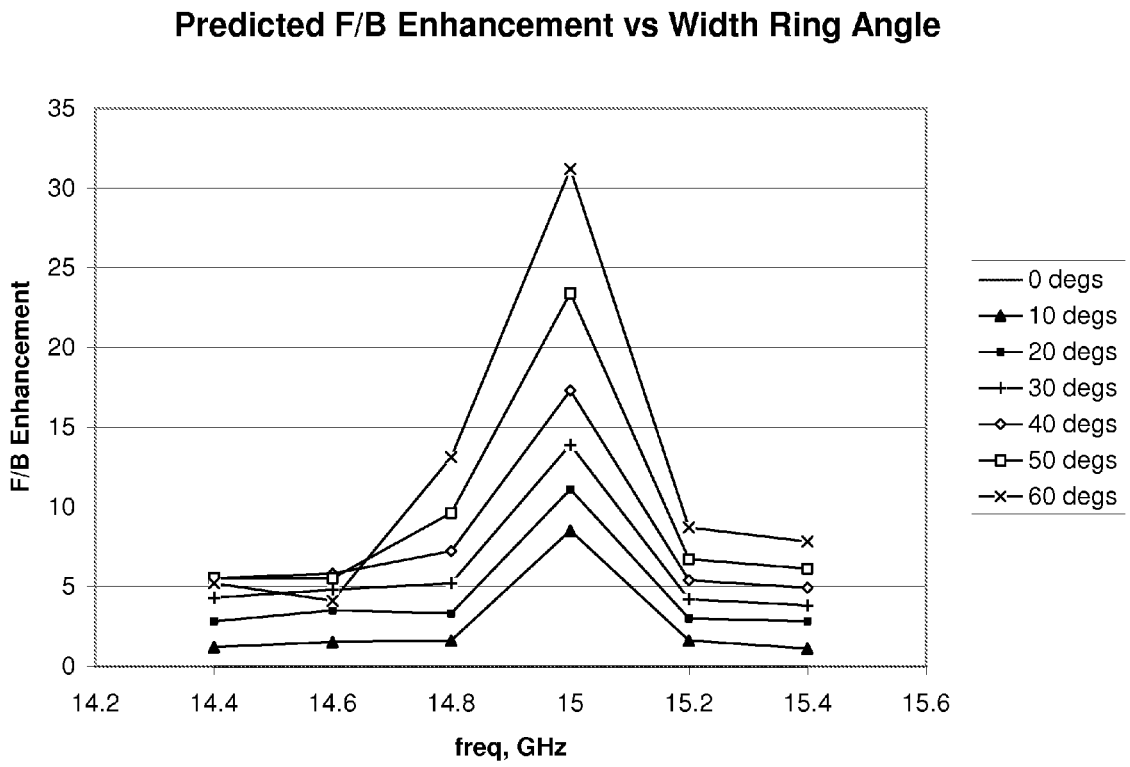
FIG. 19 is a graph comparing predicted F/B enhancement with a band clamp with a width ring configuration of between 0 and 60 degrees radial outward bend.

In a fourth embodiment, the width ring 35 may be provided in an angled configuration as demonstrated in FIG. 18. As shown in FIG. 19, RF modeling software predictions of F/B improvement indicate progressively increasing improvement as the angle applied increases from zero (flat width ring cross section) to sixty degrees of diffraction gradient.

In further embodiments, structures similar in electrical effect to the width ring 35 may be formed integral with the band clamp cross section as a protruding portion 37 of desired dimension. These complex structures may be cost efficiently formed with high precision via, for example, extrusion, injection molding, progressive punching and/or stretch forming. As shown for example in FIGS. 20-39, the protruding portion 37 creates a band clamp 1 with a generally uniform cross section in which the proximal lip 17, distal lip 15 and protruding portion 37 form a unitary contiguous portion. One skilled in the art will appreciate that the unitary contiguous portion simplifies manufacture by eliminating additional attachment steps and long term interconnection reliability concerns that may arise when separate elements such as width bands 35 are applied to the band clamp 1.

Figure 20:
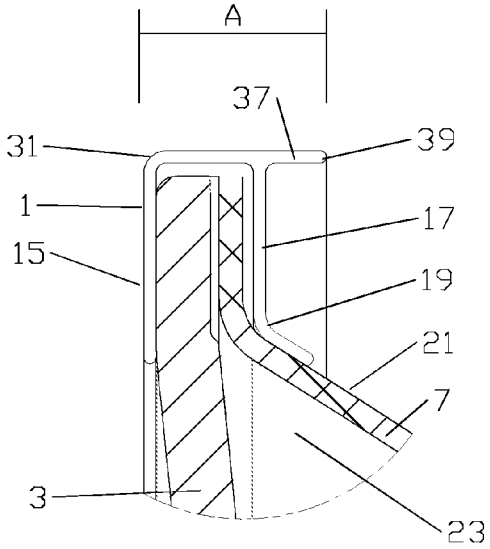
FIG. 20 is an enlarged cut-away view of another exemplary reflector dish band clamp interconnection, including a width ring with a protruding portion aligned parallel to a longitudinal axis of the reflector dish.
Figure 21:
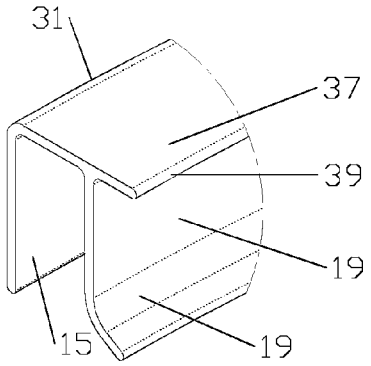
FIG. 21 is an isometric view of a section of the band clamp of FIG. 20.

As shown for example in FIGS. 20 and 21, the protruding portion 37 may be provided extending from an outer diameter of the band clamp 1 parallel to a longitudinal axis of the reflector dish 7, effectively extending the width "A" of the band clamp 1 without requiring a separate width band 35 as described herein above with respect to FIG. 12. The protruding portion 37 may be dimensioned, for example, such that the resulting band width "A" is a multiple of a quarter wavelength of a desired operating frequency of the reflector dish 7.

Figure 22:
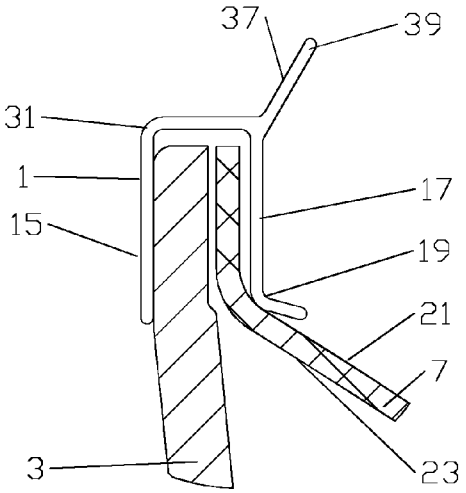
FIG. 22 is an enlarged cut-away view of another exemplary reflector dish band clamp interconnection, including a width ring with a protruding portion angled at 60 degrees with respect to a longitudinal axis of the reflector dish.
Figure 23:
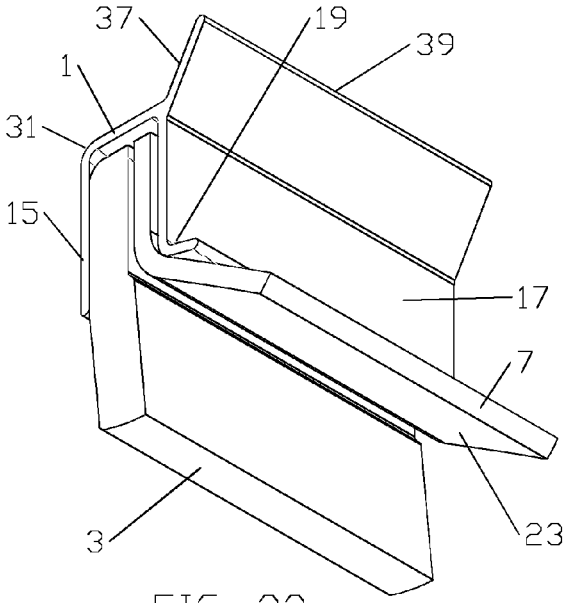
FIG. 23 is an isometric view of the interconnection of FIG. 22.
Figure 24:
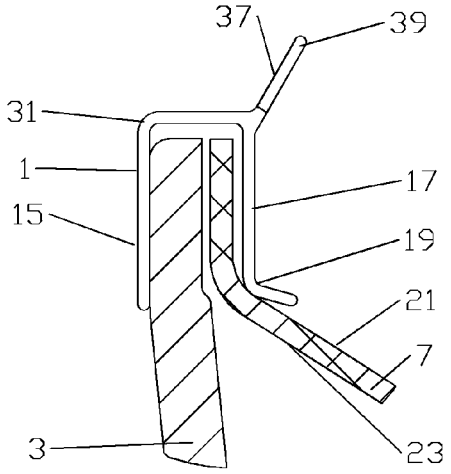
FIG. 24 is an enlarged cut-away view of another exemplary reflector dish band clamp interconnection, including a width ring with a protruding portion angled at 60 degrees with respect to a longitudinal axis of the reflector dish, demonstrating a distal edge serration.
Figure 25:
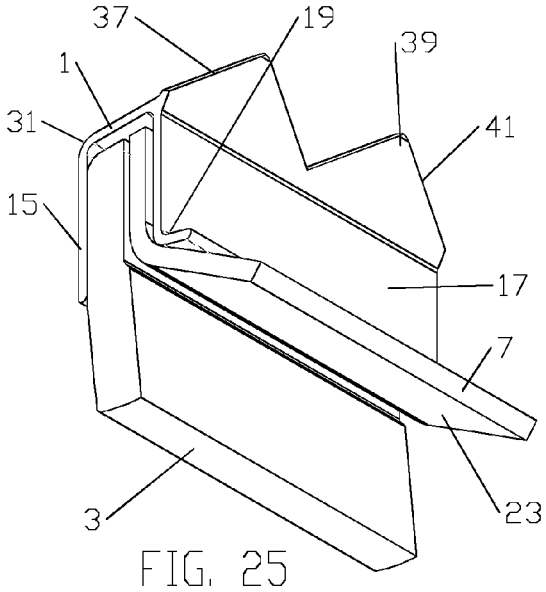
FIG. 25 is an isometric view of the interconnection of FIG. 24.
Figure 26:
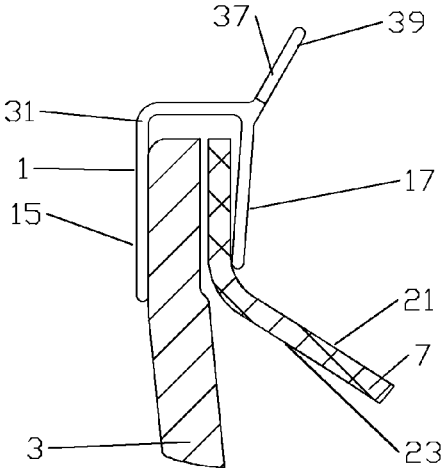
FIG. 26 is an enlarged cut-away view of another exemplary reflector dish band clamp interconnection, including a width ring with a protruding portion angled at 60 degrees with respect to a longitudinal axis of the reflector dish, demonstrating a distal edge serration and an interference fit against the reflector dish via proximal lip inward bias.
Figure 27:
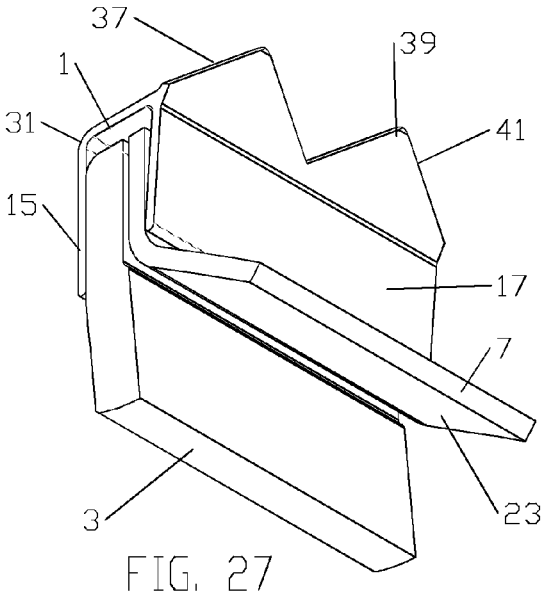
FIG. 27 is an isometric view of the interconnection of FIG. 26.
Figure 28:
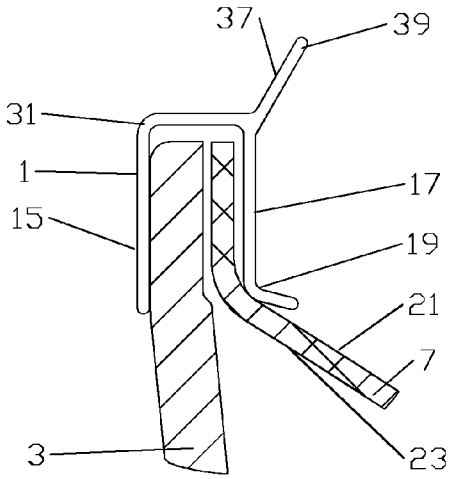
FIG. 28 is an enlarged cut-away view of another exemplary reflector dish band clamp interconnection, including a width ring with a protruding portion angled at 60 degrees with respect to a longitudinal axis of the reflector dish, demonstrating a distal edge castellation.
Figure 29:
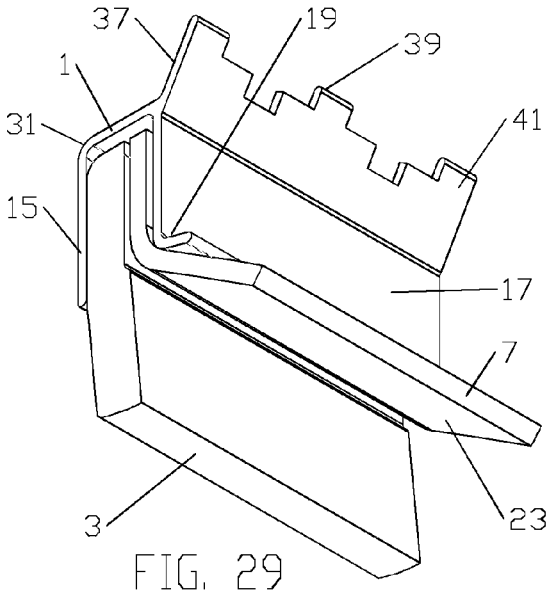
FIG. 29 is an isometric view of the interconnection of FIG. 28.
Figure 30:
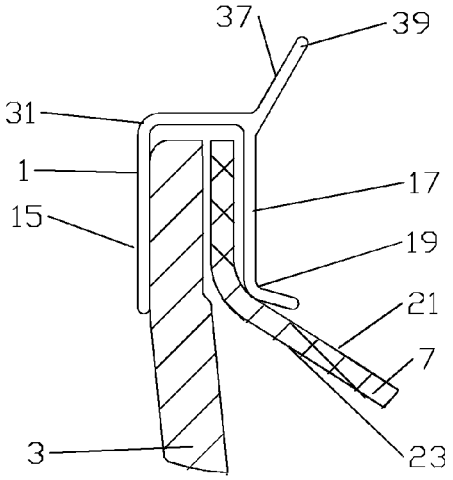
FIG. 30 is an enlarged cut-away view of another exemplary reflector dish band clamp interconnection, including a width ring with a protruding portion angled at 60 degrees with respect to a longitudinal axis of the reflector dish, demonstrating an alternative distal edge castellation.
Figure 31:
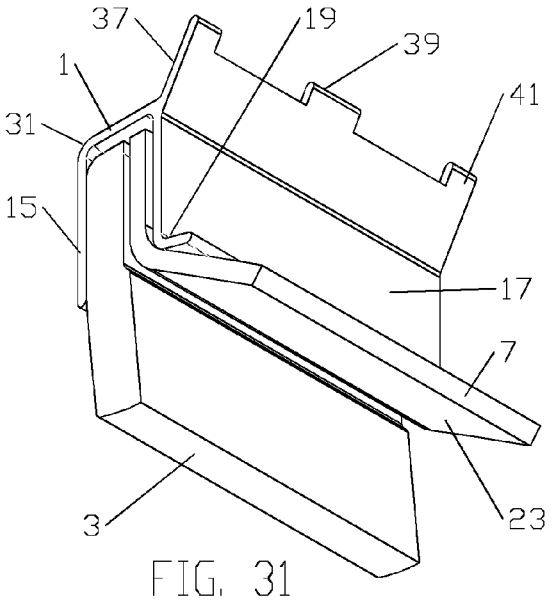
FIG. 31 is an isometric view of the interconnection of FIG. 30.
Figure 32:
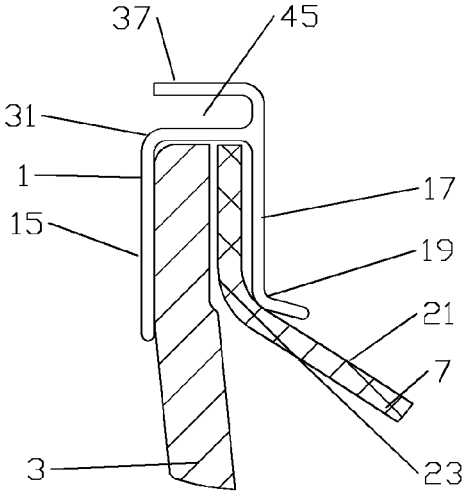
FIG. 32 is an enlarged cut-away view of another exemplary reflector dish band clamp interconnection, including a width ring with a protruding portion forming a choke groove open to a distal end of reflector dish.
Figure 33:
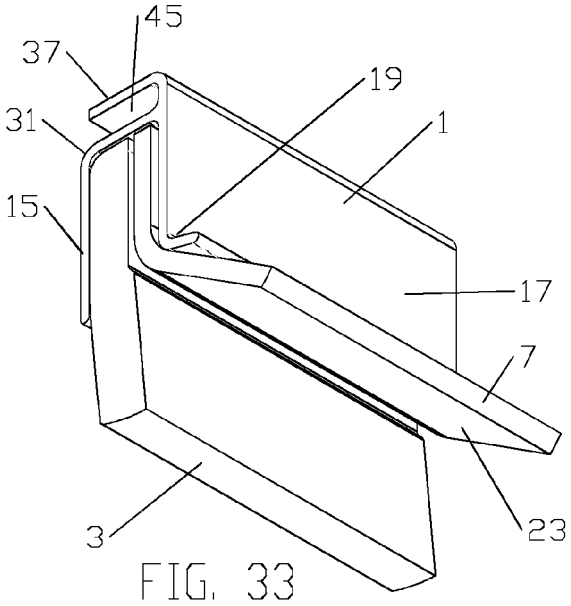
FIG. 33 is an isometric view of the interconnection of FIG. 32.

As shown for example in FIGS. 22 and 23, the protruding portion 37 may be angled as described hereinabove with respect to FIGS. 18 and 19. As modeled in FIG. 19, the angle applied to the protruding portion 37 may be, for example, 60 degrees with respect to a longitudinal axis of the reflector dish 7.

As shown for example in FIGS. 24-31, the distal edge 39 of the protruding portion may be provided with a serration 41 (FIGS. 24-27) or a castellation 43 (FIGS. 28-31) to further inhibit backlobe generation at specific operating frequencies. Treatments of the distal edge 39 to form the serration(s) 41 and/or castellation 43 may be applied as an additional fabrication step upon a uniform cross section band with protruding portion 37, for example as shown in FIGS. 22 and 23, by stamping, cutting or the like to remove the desired portions of the distal edge 39.

The protruding portion 37 may also be dimensioned to extend from the outer diameter of the band clamp 1 to form at least one choke groove 45 open to a distal end 5 of the reflector dish 7, for example as shown in FIGS. 32-35. In a trade-off with increased overall diameter of the band clamp 1, the number of choke grooves 45 may be increased. For example as shown in FIGS. 36-39, band clamp 1 may be provided with two concentric choke grooves 45.

Figure 34:
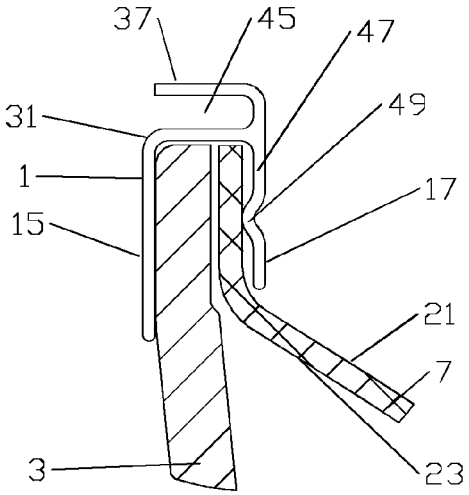
FIG. 34 is an enlarged cut-away view of another exemplary reflector dish band clamp interconnection, including a width ring with a protruding portion forming a choke groove open to a distal end of reflector dish and an annular protrusion of the proximal lip contacting the reflector dish.
Figure 35:
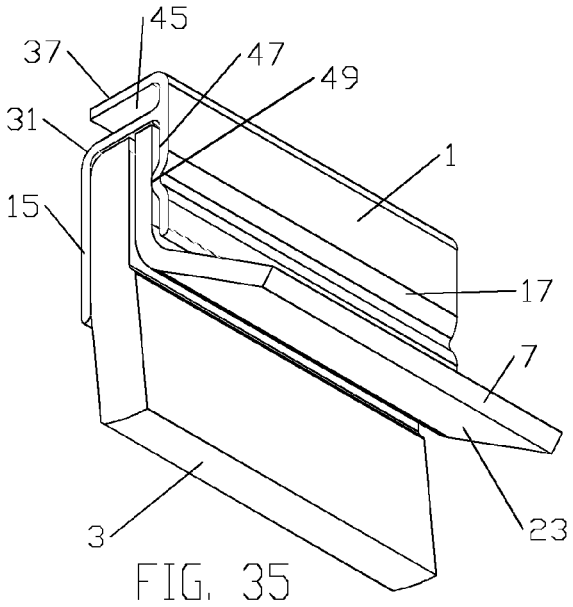
FIG. 35 is an isometric view of the interconnection of FIG. 34.
Figure 36:
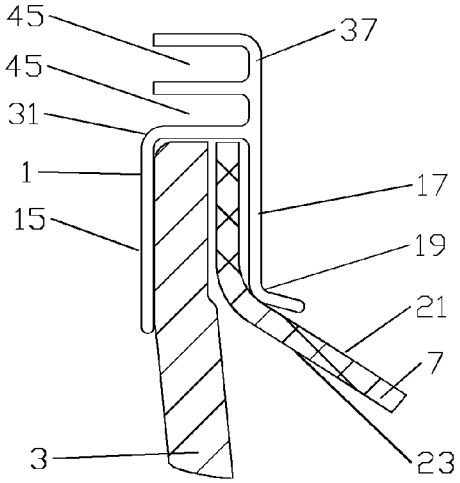
FIG. 36 is an enlarged cut-away view of another exemplary reflector dish band clamp interconnection, including a width ring with a protruding portion forming two concentric choke grooves open to a distal end of reflector dish.
Figure 37:
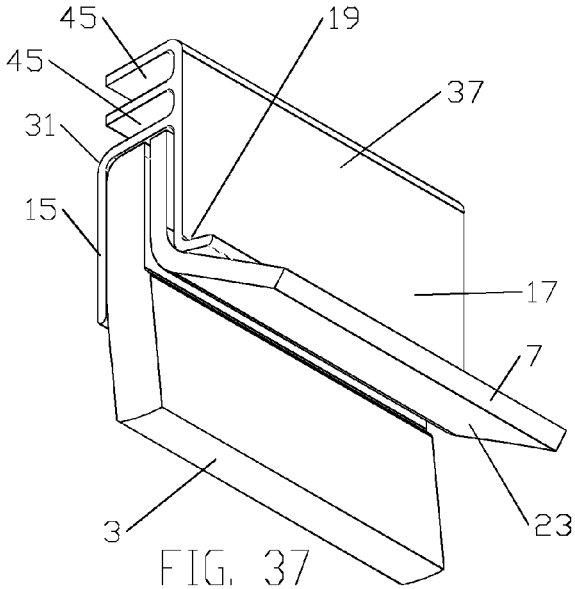
FIG. 37 is an isometric view of the interconnection of FIG. 36.
Figure 38:
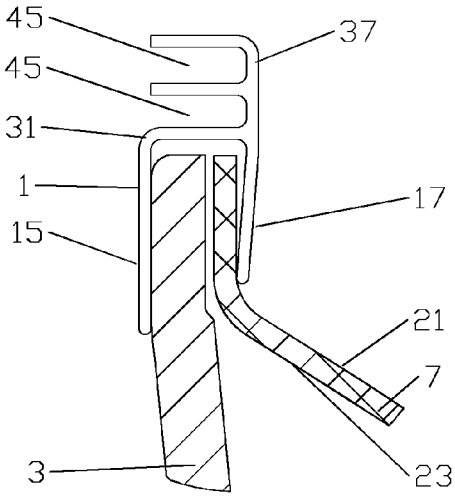
FIG. 38 is an enlarged cut-away view of another exemplary reflector dish band clamp interconnection, including a width ring with a protruding portion forming two concentric choke grooves open to a distal end of reflector dish and interference fit against the reflector dish via proximal lip inward bias.
Figure 39:
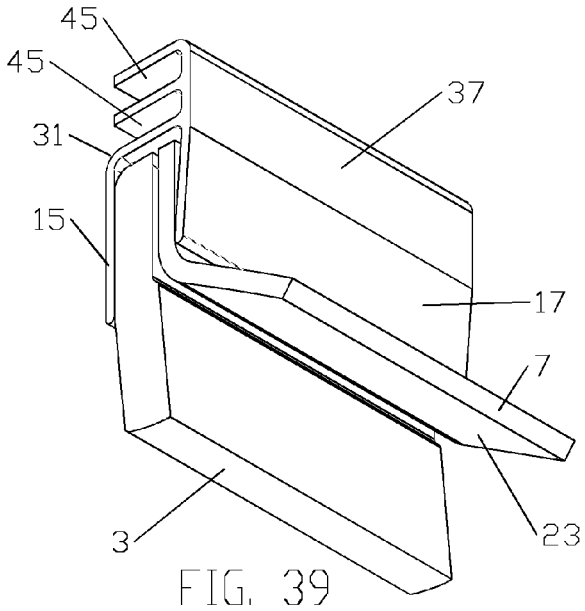
FIG. 39 is an isometric view of the interconnection of FIG. 38.
Figure 40:
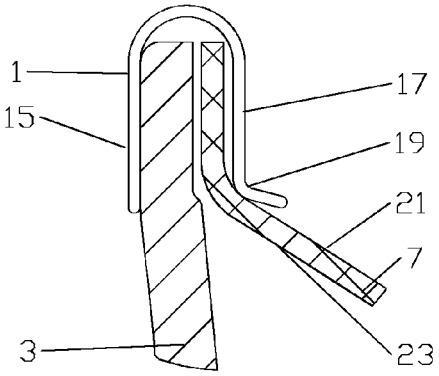
FIG. 40 is an enlarged cut-away view of another exemplary reflector dish band clamp interconnection, including an arc segment transition between the distal lip and the proximal lip.
Figure 41:
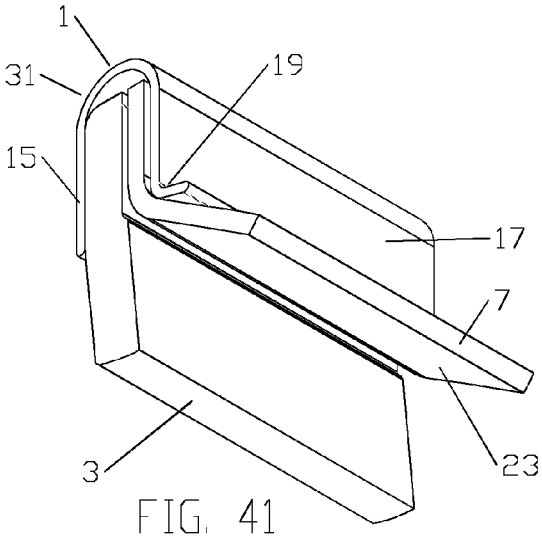
FIG. 41 is an isometric view of the interconnection of FIG. 40.
Figure 42:
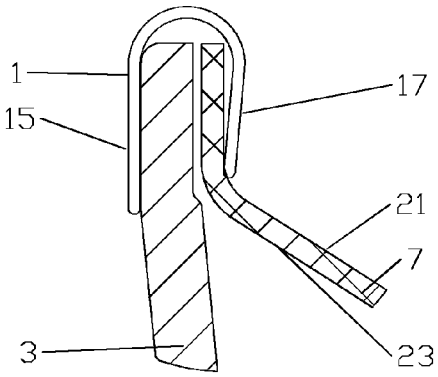
FIG. 42 is an enlarged cut-away view of another exemplary reflector dish band clamp interconnection, including an arc segment transition between the distal lip and the proximal lip and an interference fit against the reflector dish via proximal lip inward bias.
Figure 43:
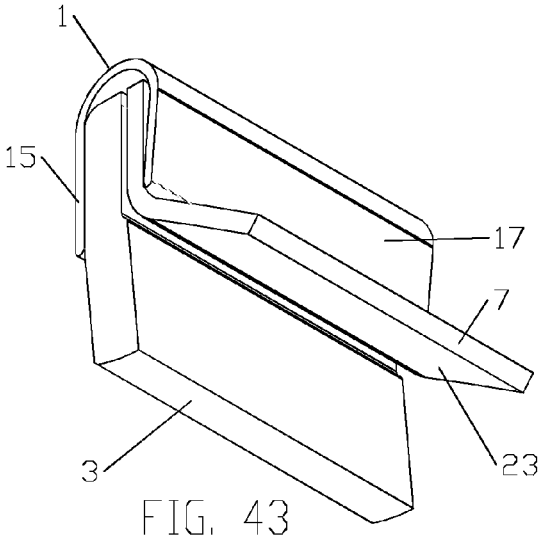
FIG. 43 is an isometric view of the interconnection of FIG. 42.
Figure 44:
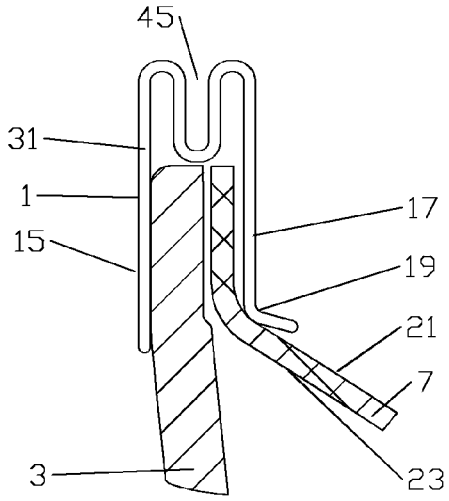
FIG. 44 is an enlarged cut-away view of another exemplary reflector dish band clamp interconnection, including a choke groove in the transition between the distal lip and the proximal lip, the choke groove open to the outer diameter.
Figure 45:
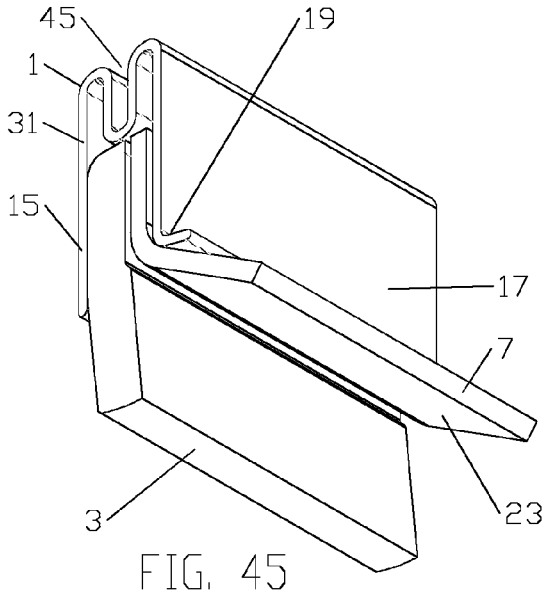
FIG. 45 is an isometric view of the interconnection of FIG. 44.
Figure 46:
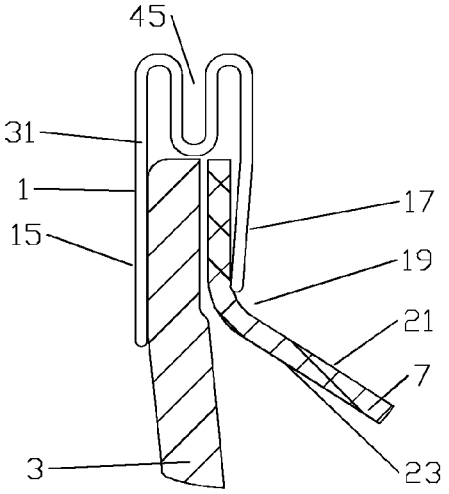
FIG. 46 is an enlarged cut-away view of another exemplary reflector dish band clamp interconnection, including a choke groove in the transition between the distal lip and the proximal lip, the choke groove open to the outer diameter and an interference fit against the reflector dish via proximal lip inward bias.
Figure 47:
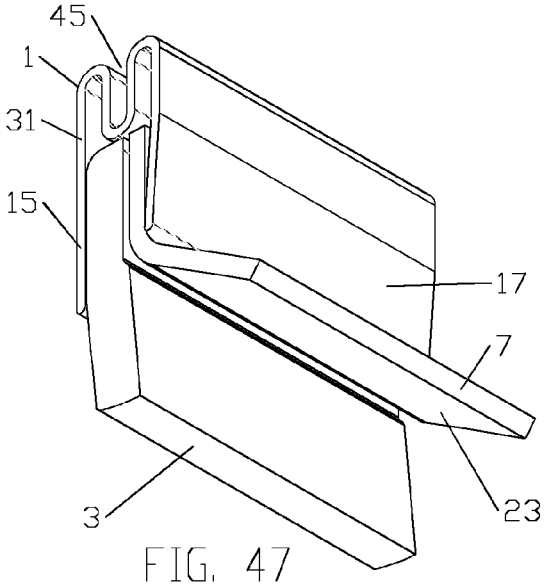
FIG. 47 is an isometric view of the interconnection of FIG. 46.

The interference fit between the band clamp 1 and the outer surface 21 of the reflector dish 7 may be alternatively obtained by providing the proximal lip 17 with an inward bias, for example as shown in FIGS. 26, 27, 34, 35, 38, 39, 42, 43, 46 and 47. Thereby, the material requirements for the band clamp 1 may be reduced in a trade-off with ease of assembly. For ease of initial insertion, a distal sidewall 47 of the proximal lip 17 may be provided with an annular protrusion 49 which contacts the reflector dish 7, for example as shown in FIGS. 34 and 35. Thereby, the inward end 25 operates as an assembly guide for the band clamp 1 over the reflector dish 7 and radome 3, prior to engaging the interference fit as the band clamp 1 is inserted far enough for the annular protrusion 49 to enage the reflector dish 7 in the interference fit.

As shown for example in FIGS. 40-43, the band clamp 1 may be dimensioned with a transition between the distal lip 15 and the proximal lip 17 formed as a continuous arc segment 51. Thereby, a material stress applied to the transition to create the bias between the distal lip 15 and the proximal lip 17 against the reflector dish 7 may be distributed across a larger portion of material, instead of being concentrated in the outer corners 31 demonstrated in the other embodiments.

As shown for example in FIGS. 44-47, the outer diameter of the band clamp 1 (the transition between the distal lip 15 and the proximal lip 17) may be provided with a choke groove 45 open to the outer diameter of the band clamp 1. Thereby, both an improved spring bias between the distal lip 15 and the proximal lip 17 against the reflector dish 7 and an electrical performance improvement may be obtained.

One skilled in the art will appreciate that in addition to improving the electrical performance of the reflector antenna 13, the disclosed band clamp 1 can enable significant manufacturing, delivery, installation and/or maintenance efficiencies. Because the band clamp 1 enables simplified radome and reflector dish periphery geometries, the resulting reflector antenna 13 may have improved materials and manufacturing costs. Because the band clamp 1 is simply and securely attached, installation and maintenance may be simplified compared to prior reflector antenna configurations with complex peripheral geometries, delicate back lobe suppression ring coatings, platings and/or RF absorbing materials. Because the band clamp 1 may be compact and applied close to the reflector antenna aperture H, the overall diameter of the reflector antenna 13 may be reduced, which can reduce the reflector antenna wind loading characteristics and the required packaging dimensions. Where the band clamp 1 is fabricated utilizing extrusion, injection molding, progressive punching and/or stretch forming, complex band clamp 1 cross sections providing additional electrical performance may be provided in the form of a protruding portion 37 with specific geometries, without requiring separate elements with additional attachment and/or reliability concerns.

Table of Parts

| | |
|---|---|
| 1 | band clamp |
| 3 | radome |
| 5 | distal end |
| 7 | reflector dish |
| 9 | subreflector |
| 11 | feed |
| 13 | reflector antenna |
| 15 | distal lip |
| 17 | proximal lip |
| 19 | turnback region |

-continued

Table of Parts

| | |
|---|---|
| 21 | outer surface |
| 23 | signal area |
| 25 | inward end |
| 27 | proximal end |
| 29 | annular lip |
| 31 | outer corner |
| 33 | fold |
| 35 | width ring |
| 37 | protruding portion |
| 39 | distal edge |
| 41 | serration |
| 43 | castellation |
| 45 | choke groove |
| 47 | distal sidewall |
| 49 | annular protrusion |
| 51 | arc segment |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A band clamp for coupling a radome to a distal end of a reflector dish, comprising:

a band with an inward projecting proximal lip and an inward projecting distal lip;

the distal lip dimensioned with an inner diameter less than or equal to a reflector aperture of the reflector dish;

the proximal lip provided dimensioned to engage an outer surface of the reflector dish in an interference fit; and a protruding portion extending from an outer diameter of the band clamp;

the proximal lip, the distal lip and the protruding portion provided as a unitary contiguous portion.

2. The band clamp of claim 1, wherein a distal edge of the protruding portion is serrated.

3. The band clamp of claim 1, wherein a distal edge of the protruding portion is castellated.

4. The band clamp of claim 1, wherein the protruding portion extends toward a proximal end of the reflector dish.

5. The band clamp of claim 1 wherein the protruding portion has a length dimensioned as a multiple of one quarter wavelength of a desired operating frequency of the reflector dish.

6. The band clamp of claim 1, wherein the protruding portion extends outward at an angle of approximately 60 degrees from a longitudinal axis of the reflector dish.

7. The band clamp of claim 1, wherein the protruding portion extends from an outer diameter of the band clamp; the protruding portion forming at least one choke groove open to a distal end of the reflector dish.

8. The band clamp of claim 7 wherein a width of the choke groove is dimensioned as a multiple of one quarter wavelength of a desired operating frequency of the reflector dish.

9. The band clamp of claim 7, wherein the at least one choke groove is two concentric choke grooves.

10. A method for manufacturing a band clamp for coupling a radome to a distal end of a reflector dish, comprising the steps of:

forming a band with an inward projecting proximal lip and an inward projecting distal lip;

a protruding portion extending from an outer diameter of the band clamp;

the proximal lip, the distal lip and the protruding portion provided as a unitary contiguous portion;

the distal lip dimensioned with an inner diameter less than or equal to a reflector aperture of the reflector dish;

the proximal lip provided dimensioned to engage an outer surface of the reflector dish in an interference fit.

11. The method of claim 10, wherein the band is formed by extrusion.

12. The method of claim 10, wherein the band is formed by injection molding and metalizing.

13. The method of claim 10, wherein the band is formed by progressive punching.

14. The method of claim 10, wherein the band is formed by stretch forming.

* * * * *